US007113090B1

(12) United States Patent
Saylor et al.

(10) Patent No.: US 7,113,090 B1
(45) Date of Patent: Sep. 26, 2006

(54) SYSTEM AND METHOD FOR CONNECTING SECURITY SYSTEMS TO A WIRELESS DEVICE

(75) Inventors: Michael J. Saylor, McLean, VA (US); Alison Slavin, Vienna, VA (US); Jean Paul Martin, Oakton, VA (US); Stephen Scott Trundle, Falls Church, VA (US)

(73) Assignee: Alarm.com Incorporated, McLean, VA (US)

( * ) Notice: Subject to any disclaimer, the term of this patent is extended or adjusted under 35 U.S.C. 154(b) by 0 days.

(21) Appl. No.: 11/190,016

(22) Filed: Jul. 27, 2005

Related U.S. Application Data

(63) Continuation-in-part of application No. 10/683,299, filed on Oct. 14, 2003, now Pat. No. 6,965,313, which is a continuation of application No. 09/840,302, filed on Apr. 24, 2001, now Pat. No. 6,661,340.

(51) Int. Cl.
*G08B 1/08* (2006.01)

(52) U.S. Cl. ..... 340/539.18; 340/539.11; 340/5.33

(58) Field of Classification Search ..... 340/539.1, 340/539.18, 539.11, 5.33, 517, 531, 541, 340/506, 539.13
See application file for complete search history.

(56) References Cited

U.S. PATENT DOCUMENTS

| | | | |
|---|---|---|---|
| 4,446,454 | A | 5/1984 | Pyle |
| 4,581,606 | A | 4/1986 | Mallory |
| 4,777,474 | A | 10/1988 | Clayton |
| 5,027,383 | A | 6/1991 | Sheffer |
| 5,195,126 | A | 3/1993 | Carrier et al. |
| 5,438,607 | A | 8/1995 | Prygoda, Jr. et al. |
| 5,499,014 | A | 3/1996 | Greenwalt |
| 5,621,385 | A | 4/1997 | Camey |
| 5,638,046 | A | 6/1997 | Malinowski |
| 5,777,551 | A | 7/1998 | Hess |
| 5,861,804 | A | 1/1999 | Fansa et al. |
| 5,867,105 | A | 2/1999 | Hajel |
| 5,892,442 | A | 4/1999 | Ozery |
| 6,032,036 | A | 2/2000 | Maystre et al. |
| 6,035,016 | A | 3/2000 | Moore |
| 6,049,272 | A | 4/2000 | Lee et al. |
| 6,049,273 | A | 4/2000 | Hess |
| 6,052,052 | A | 4/2000 | Delmonaco |
| 6,133,830 | A | 10/2000 | D'Angelo et al. |
| 6,211,783 | B1 * | 4/2001 | Wang ..... 340/506 |
| 6,295,346 | B1 | 9/2001 | Markowitz et al. |
| 6,369,705 | B1 | 4/2002 | Kennedy |

* cited by examiner

*Primary Examiner*—Toan N. Pham
(74) *Attorney, Agent, or Firm*—Hunton & Williams LLP

(57) ABSTRACT

The present invention provides a personal security network where an individual's system or systems of security devices may be connected to a central security network. The central security network of the present invention may monitor a system's status and alert the individual when an alert situation occurs. The present invention provides a security network where a user may set up personalized alarms and alert services; identify various methods of contact; order at which to be contacted; individuals and entities to be contacted; type of situations to be alerted of and other relevant security and other information. The present invention may further provide a personalized web interface where authorized individuals may view current and historical security device status. A user may generate personalized reports based on aggregated historical data based on various user-defined factors. The reports may be displayed to the user in various formats, such as maps, graphs, statistics, and others.

72 Claims, 18 Drawing Sheets

SYSTEM AND METHOD FOR CONNECTING SECURITY SYSTEMS TO A WIRELESS DEVICE

CROSS-REFERENCE TO RELATED APPLICATIONS

This patent application is a continuation in part of U.S. patent application Ser. No. 10/683,299, filed Oct. 14, 2003, now U.S. Pat. No. 6,965,313, which is a continuation of U.S. patent application Ser. No. 09/840,302, now U.S. Pat. No. 6,661,340 B1, which are hereby incorporated by reference herein in their entirety.

FIELD OF INVENTION

The present invention relates generally to the field of security systems, in particular to a system and method for connecting a security system to a wireless communication system to automatically inform an owner and other authorized entities in a manner predetermined by the user when alarm situations and/or alarm worthy situations occur.

BACKGROUND OF THE INVENTION

Home security and personal safety are major concerns for individuals. People want to protect their valuables and provide a safe haven for family members and loved ones. Traditional home security systems generally alert neighbors and others within the vicinity with a loud noise warning the intruder or intruders that the invasion has been detected. In addition, home alarms generally inform a home security central system of the unauthorized entry. The home security central system then alerts the police and/or third party security companies that an unauthorized entry has occurred. Home security devices generally involve window detectors, door detectors, motion sensors and other devices.

High false alarm rates pose a serious problem in communities. False alarms deplete police resources and undermine the credibility of systems that appear to repeatedly malfunction. In response to the high number of false alarms (over 90% in some areas), counties and other localities may fine alarm owners whose systems repeatedly produce false alarms in an attempt to reduce staggering false alarm rates. In some communities, laws have been passed that prevent the police from responding to an alarm activated by a security system. As a result, alarm owners may be forced to employ expensive third party security companies to respond to alarm situations.

Some systems may place a confirmation call or communication to the owner before dispatching the police or other security entity. This may be helpful when the owner is at home to explain that the alarm was a false alarm thereby preempting the alarm and police dispatch. In other situations, the alarm may have been triggered inadvertently by a pet, falling branch or other innocent act while the home owner is away. In such an event, an attempt to make a confirmation call to the owner at home is ineffective. Traditional central alarm systems often fail to proactively contact a home owner while the home owner is in transit. In addition, power failures and other power cutoffs may prevent traditional alarm systems from contacting a user in the event of an alarm situation.

Currently, home security systems offer limited services. Generally, all alarm situations are treated in the same manner. The industry itself has remained stagnant and inflexible. Generally, current security services are confined to sounding an alarm and/or dispatching the police or other security entity. Depending on the type of event detected, a user may desire responses in varying degrees of severity. Similar problems exist with other security systems for office buildings, cars, boats, vaults and other objects or locations.

These and other drawbacks exist with current systems.

SUMMARY OF THE INVENTION

The present invention provides a security system connected to a wireless communication system which enables communication with a subscribed user when an alarm (or other defined) situation occurs. The security system may be applied to a user's home, office, vacation house or other location. The security system may also be applied to a user's mobile property, such as a car, boat or other personal property. In addition, a security system may encompass personal security devices for individuals, such as a panic device.

According to one embodiment, the present invention provides a personal security network where one or more security devices related to a subscriber may be connected to a central security network over wireless communication. The central security network of the present invention may monitor those security devices and alert a user when an alert situation occurs. The user may set up personalized alarms and alert services; identify various methods of contact; identify the order at which to be contacted; individuals and entities to be contacted; select the type of situations for which they want to be alerted and provide other relevant security and other information.

A personalized web interface (e.g., Internet, wireless web, PDA web, etc.) may also be provided through which a user and authorized individuals may view current and historical security device status. A user may initiate contact with a web interface to conveniently view and/or monitor data for registered alarm sensors at various locations, zones, etc. A user may also generate personalized reports or have those reports automatically generated for them from aggregated historical data and other information based on user defined factors, such as area of interest, type of event(s), time frame(s) and other factors. The reports may be displayed to the user in various formats, such as maps, graphs, statistics, and others formats.

According to this or other embodiment, the present invention may further provide a monitoring system for providing images (e.g., photos, pictures, video, diagrams, illustrations, etc.) where an alarm situation may be detected by comparing images. When a change in images (indicating motion) is detected, an alarm may be signaled. In addition, the image and other information may be conveyed to a central security network where identified individuals may be alerted via identified methods. The user may also view the images (e.g., video clips) remotely via the web or other remote access methods.

Users may also monitor and/or control appliances and objects remotely via a wireless channel, which may also be the channel used to send alarm events, alarm broadcasts and other information.

According to another embodiment of the present invention, the system of the present invention provides a wireless communication device at a home security system which relays a wireless communication from the home security device directly to the user's desired devices in such a way so that power failures and other power cutoff situations do not prevent the relay of information to the owner and other points of contact.

Another embodiment of the present invention provides the ability to report an index of activity within an identified area. The identified area may include a house, one or more rooms within a house, an office, store location, warehouse, multiple locations, any identified area, etc. The area may also be defined by one or more sensor or other monitor devices. The index of activity may be based on data gathered from one or more sensor devices, such as contacts, motion sensors and/or other devices, at the identified area. The index of activity may be reported to a subscriber or other recipient. The information may be conveyed via one or more preferred modes of communication (e.g., wireless communication, broadband, landline, etc.). In addition, the index of activity may be displayed on an online interface, as a graphical representation or other display.

Another embodiment of the present invention provides the ability to identify anomaly information. A subscriber (or other recipient) may be alerted if activity patterns at a location differ from previous activity patterns. A subscriber may define an activity baseline through an interface or other mode of communication. The activity baseline may indicate a level of "normal" activity. Using the activity baseline, an embodiment of the present invention may identify whether or how much the activity varies from the activity baseline for an alert (or other message) to be delivered. A variance amount may be identified to detect when an alert message is transmitted. Recipients and their corresponding preferred communication methods may be identified.

An embodiment of the present invention is directed to a single interface for displaying security data for a plurality of locations. Devices (e.g., sensors, monitors, etc.) may be controlled across locations through this single interface. This feature of an embodiment of the present invention provides a single login and a single interface for viewing subsets of information for a plurality of locations at once. In addition, different security privileges may be assigned to different enterprise users for control of a security system, which may include one or more different locations. This action may be performed through the single interface. The security privileges may be assigned in a hierarchical format where one user can set the code for a group of users, separate from another user and another group of users.

An embodiment of the present invention enables a subscriber to arm a system (or identified group of sensors) automatically. An exemplary application may involve a situation where a system has been left disarmed by mistake. A typical application may involve a store where an owner/manager wants to ensure that a system is armed at night even if the last employee to leave the building forgets to arm the system.

An embodiment of the present invention is directed to moving functionality currently built into and enabled by circuitry and programming deployed inside each Security Control Panel into one or more centralized security servers, the Centralized Security Control Panel hosted at one or more central network operations centers (NOC). Currently, the requirement to deploy a Security Control Panel which contains and supports all of the logic of the Security Systems results in a more expensive deployment and less capable system than is often desired. Additionally, since the logic of the security system is physically deployed in a home or business, it is often very difficult or impossible to update the system with new capabilities without considerable installation and retrofit expense.

Through an embodiment of the present invention, all or most of the programming logic of the Security Control Panel is moved to Centralized Security Control Panel, hosted in a NOC, where data (e.g., monitor data, event data, arming state, site configuration properties, security settings, user codes and user access privileges, alarm handling instructions, etc.) are gathered and maintained and used to direct the behavior of the security system at a remote physical site. The Security Control Panel does not host or maintain any of this information and is essentially virtual. Rather, the Security Control Panel is simply a messaging hub which receives messages from sensors which indicate the sensors state, and which in turn, routes those messages to the Centralized Security Control Panel where logic is applied to determine whether the messages constitute an event which might require a response (e.g., sounding a siren, disarming a set of sensors, sounding a chime, initiating an arming sequence, enabling a new user code, etc.).

According to another embodiment of the present invention, the sensors themselves may simply message their state (or other information) to a central system where a "security system" simply becomes a collection of sensors who send their state (and/or other information) to a central system via a network (e.g., wireless, broadband, etc.).

Additional advantages of the invention will be set forth in part in the description which follows, and in part will be apparent from the description, or may be learned by practice of the invention. The advantages of the invention may be realized and attained by means of the instrumentalities and combinations particularly pointed out in the appended claims.

The accompanying drawings, which are incorporated in and constitute a part of this specification, illustrate various embodiments of the invention and, together with the description, serve to explain the principles of the invention.

DETAILED DESCRIPTION OF THE PREFERRED EMBODIMENTS

The present invention may provide a security system where a user may personalize alert notifications for various security devices and/or systems. The present invention may also provide access to a web interface (e.g., personal web page) where a user may monitor current security status and other information. Historical data may also be available for the user to generate reports based on aggregate data from security systems within the network and/or other sources of data. A user may register security devices and/or systems with the central security network of the present invention. The central security network may access the user's personal preferences, profile information and/or other information which may be used to execute notifications in the manner specified by the user. For example, the user may identify various personal preferences, which may include contact information, contact individuals, methods of communication, order of contact, special instructions and other information.

For example, when an alert situation is detected, a security device may inform a local control panel, which may then inform a central security network. The user may be informed of an alarm situation and/or alarm worthy situations via web, WAP, voice and other methods of communication, depending on the user's preferences, permissions and/or other information.

According to an embodiment of the present invention, a central security system may include a network where a user may benefit from information from and connection to other users. For example, the system may immediately notify a user about burglar strikes (or other user identified alarm situation) in the user's neighborhood or defined area (radius of interest or other location). The present invention may further provide preventive information when a user is notified of alarm information or other predefined situations.

Users may sign up for services that contact the user (and/or other authorized individuals and/or entities) when an alarm goes off in the user's system, when an alarm worthy situation is predicted (or otherwise detected) by the network, when a neighbor is experiencing an alarm situation and/or at the occurrence of other events. The conditions setting off an alarm, the content of the alarm service, and list of recipients who may be contacted in the event of an alarm, may be personalized and updated through a web site (or other user interface system) of the present invention.

Figure 1:
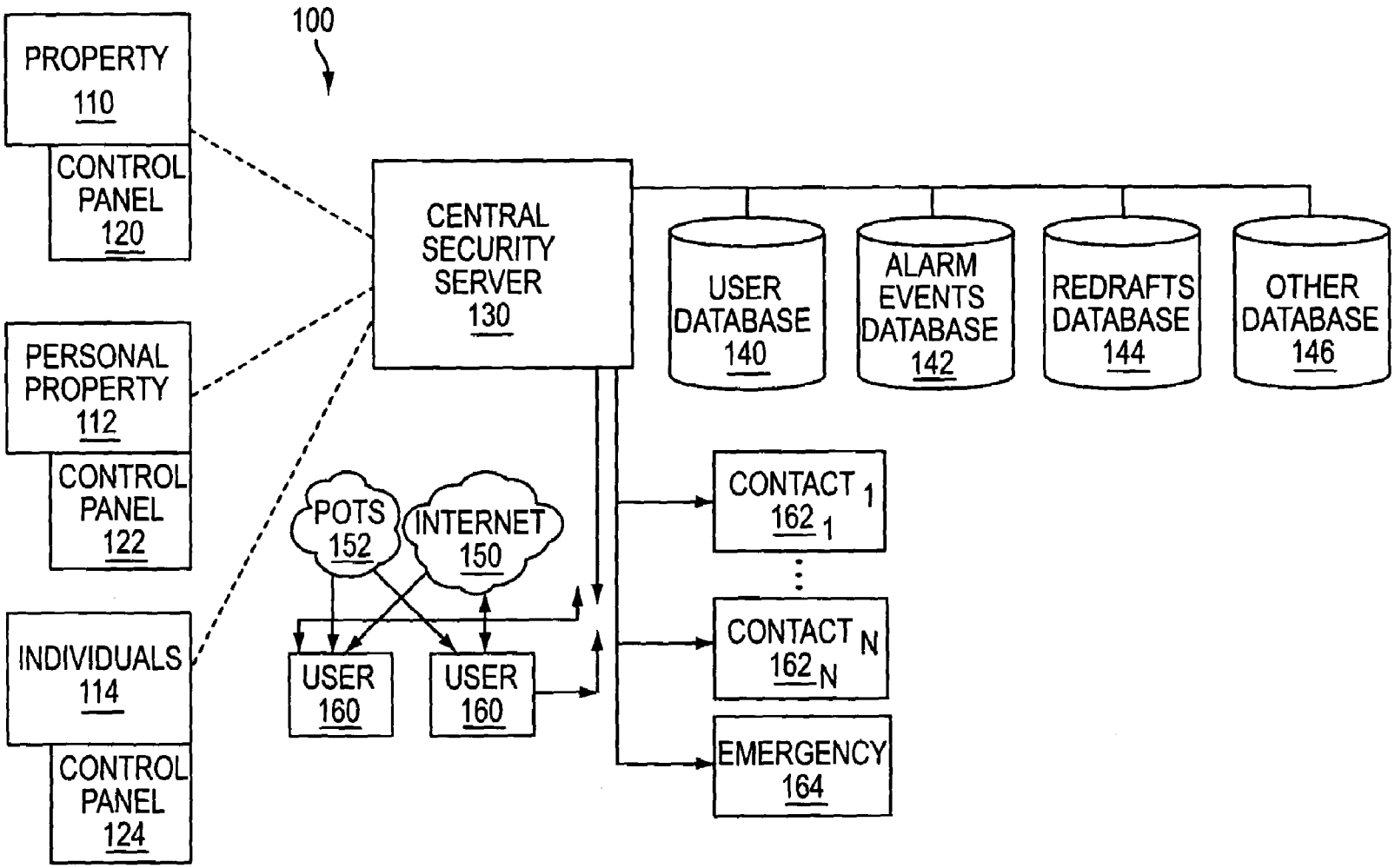
FIG. 1 is a graphical representation of a security system with wireless access, according to an embodiment of the present invention.

FIG. 1 is a graphical representation of a central security network system 100, according to an embodiment of the present invention. A user may register various types of security devices, including those associated with property 110, personal property 112 and/or individuals 114 with the central security network 130 of the present invention. Alarm situations may be detected by a control panel 120, 122, 124 associated with and preferably local to each security device and/or system (e.g., property, personal property, individual, or combination). Control panels 120, 122, 124 may transmit alarm information to central security network 130. Central security network 130 may process the alarm situation, status data and/or other relevant information.

Databases 140, 142, 144 and 146 may store relevant information for personalized alarm services. While shown as separate databases, it should be appreciated that the contents of these databases may be combined into fewer or greater numbers of databases and may be stored on one or more data storage systems. User information may be obtained from user database 140. Alarm events and other information may be stored in alarm events database 142. A user may generate reports based on historical and/or other data which may be stored in reports database 144. Other information may be accessed and/or stored in other database 146. Based on user preferences and other information, the user may be notified via various methods of communication, as specified in the user's profile and preferences information. Alert notification may be communicated via the Internet 150, POTS 152, wireless communication portals, voice portals, and/or other methods. Contact individuals and/or entities $\mathbf{161}_1$–$\mathbf{162}_N$ identified by the user may also receive alert notification in an order determined by the user. The contact order and other actions may be predetermined. In addition, the user may select contact order and/or other actions through menu options at the time of alarm situation notification. An emergency entity 164, such as police, fire department, and/or rescue squads, may receive alert information.

A user may subscribe security systems associated with various objects within the central security network 130 of the present invention. The security system may be applied to property 110, personal property 112, individuals 114 and other objects. Property 110 may include user's home, office, vacation house or other locations. The security system may also be applied to a user's personal property 112, such as a car, boat or other mobile property. A security system may encompass personal security devices for individuals 114, such as a panic device. Other objects, locations, and property may be protected.

Various security devices may be associated with each location, item of personal property, or individual within the central security network of the present invention. For property 110, security devices may include sensors, detectors and/or other devices for detecting alarm situations. For personal property 112, security devices may include global positioning devices associated with devices capable of sensing and/or detecting alarm situations. For individuals 114, security devices may include a panic button or other similar device. Other security devices may be implemented with the system of the present invention. For example, wireless panic buttons with GPS transponders may be available as stand alone devices and may be built into mobile phones, cars, walkmen, bicycles, wristwatches and/or other portable or mobile devices. Thus, a user may alert the authorities any time the user is in danger, from anywhere, and transmit location information detailing the user's position and/or other information. Other variations may be implemented.

According to an embodiment of the present invention, security devices may be predominantly wireless and communicate locally over short-range radio or other modes of communication. Each of the sensors (or group of sensors) may be equipped with a transmitter and the control panel may be equipped with a receiver. A control panel of the present invention may receive regular status information from the sensors and may be alerted when a sensor detects an alarm situation. Other information may be received by the control panel. Transmission of regular status information may occur at predetermined intervals, as well. For example, the sensors may send digital data packets providing status and other data at 10 second intervals. Also, on or off status information may be conveyed to central security network 130.

When an alarm situation is detected, a local control panel 120 or other similar device may communicate to a central security network 130 of the present invention. Control panels 120 may serve as a link between an alarm system (for each property, personal property, individual, or combination) and a central security network of the present invention. Communication may be established through various mediums. An example may include a radio modem (e.g., CreateaLink 2XT radio modem) which may transmit radio waves at a predetermined frequency (e.g., 900 MHz) which may then be received by central security network 130 or at an intermediary system that relays the signal over a secondary communication channel (e.g., TCP/IP system) to central security network 130. Other examples of modes of communication may include POTS (plain old telephone service), cable modem, DSL (digital subscriber links), wireless (two-way pager, packet switched, telephone cellular networks) and others.

Figure 2:
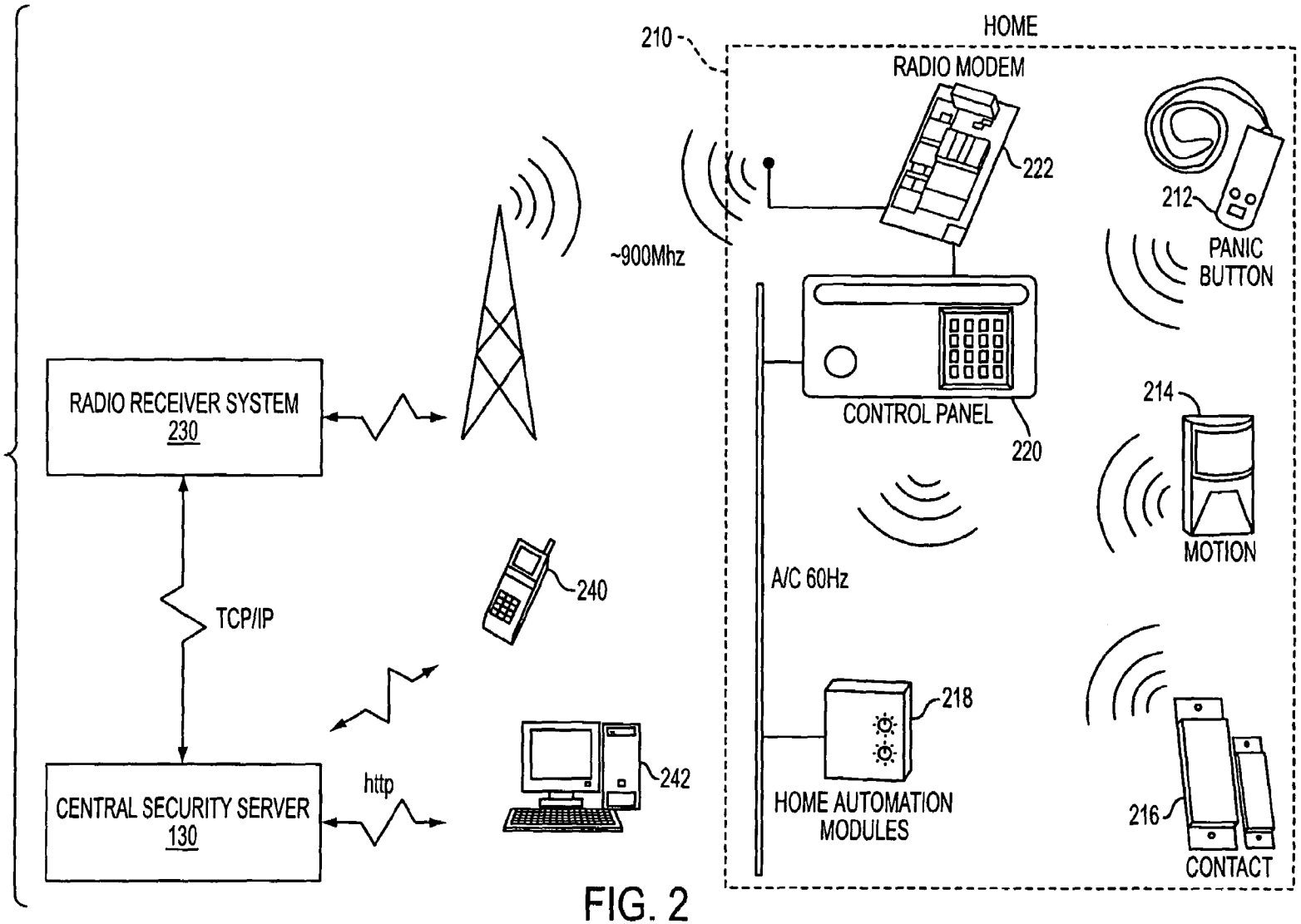
FIG. 2 is an example of an alarm transmission, according to an embodiment of the present invention.

FIG. 2 is an example of an alarm transmission, according to an embodiment of the present invention. A location, such as home 210, may include various security and/or other devices, such as panic button 212, motion sensor 214, motion contact 216, home automation modules 218, which communicate with control panel 220. Control panel 220 may send a signal via radio modem 222 to radio receiver system 230. For example, radio modem 222 may transmit alarm and other data at a frequency of approximately 900 Mhz. Other frequencies may also be transmitted and detected. Radio receiver system 230 may then communicate with central security server 130 via a TCP/IP connection. Other communication techniques may be implemented. Central security server 130 may then alert users and other identified entities via wireless and/or other devices, such as mobile device 240, via a voice alarm, text message and other notifications. For example, alerts may be transmitted to the user via email or other form of electronic communication to a personal computer 242 or other device. In addition, users may check status and other data via mobile device 240, computer 242 and other devices.

Figure 3:
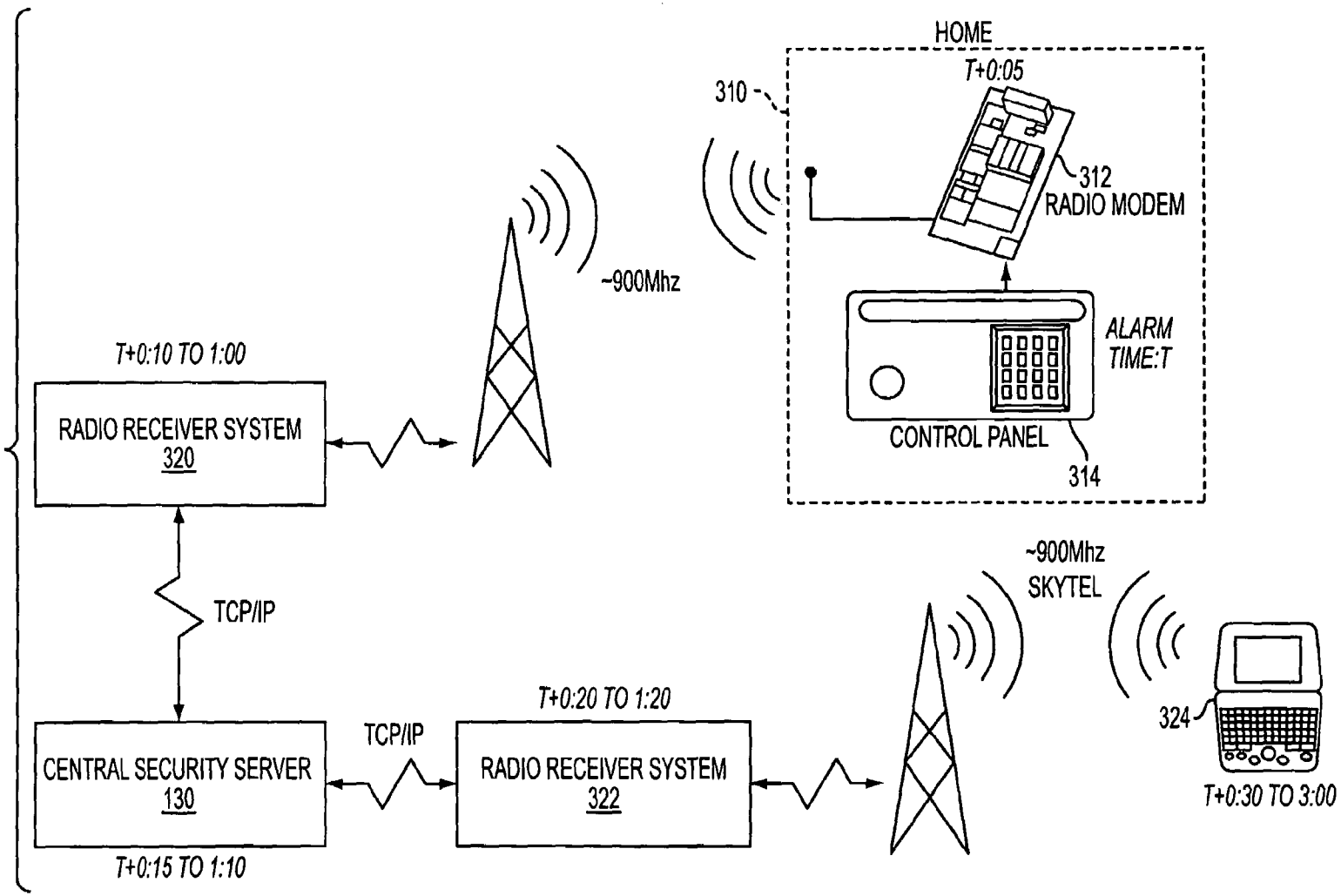
FIG. 3 is an example of alarm propagation, according to an embodiment of the present invention.

FIG. 3 is an example of alarm propagation, according to an embodiment of the present invention. The alarm system of the present invention provides an efficient method for transmitting an alarm situation and promptly notifying a user and/or other identified entity. According to an example of the present invention, alarm data may be transmitted from control panel 314 to a user's mobile or other device at approximately 30 seconds to approximately 3 minutes. At time T, control panel 314, located at home 310 or other location, may communicate alarm data to radio modem 312, at time T+0:05. Radio receiver system 320 may receive the transmitted data at time T+0:10 to 1:00. Communication to central security server 130 may be established at time T+0:15 to 1:10. Communication to radio receiver system 322 may be established at time T+0:20 to 1:20. At time T+0:30 to 3:00, alarm data may be transmitted to a user's device, such as a two-way pager 324.

According to an embodiment of the present invention, the central security network may provide wireless backup for one or more communication connections. For example, the present invention may include a combination of a POTS connection with wireless back-up. In the event of an alarm, the control panel may attempt to use the phone line to transmit data to a central security network. If data transmission via POTS is unsuccessful (e.g., if someone were using the phone), the control panel may send the data wirelessly to the central security network. In another example, a user may integrate still or motion video into an alarm system through the use of a broadband landline (e.g., cable or DSL) for image transmission with a wireless connection to send alarm data. Other combinations may be implemented.

According to an embodiment of the present invention, control panel 120 may transmit alarm information to central security network 130 at the detection of an alarm situation. Various user defined options may be available. For example, control panel 120 may trigger an alarm sound when an alarm situation has been detected. Based on user defined preferences, a user may be notified before the sounding of an alarm and before contacting an emergency entity (e.g., police, ambulance, etc.) to reduce false alarm penalties and fees. In addition, control panel 120 may trigger an alarm sound and confirm with the user via notification methods where the user may terminate the alarm sound if determined to be false, before an emergency entity has been contacted. Thus, the user may specify that an alarm sound be triggered but police notification to be confirmed by the user before dispatch. In another example, if the user cannot be contacted for confirmation within a predetermined time frame, the system may automatically contact an emergency entity. The user may personalize various parameters and responses based on the alarm situations involved. Other variations may be implemented.

Central security network 130 may process the alarm situation. User profile information may be retrieved from user database 140. User database 140 may contain user information, such as profile information, user preferences, contact information, special instructions and/or other information. User profile information may include one or more of name, identification information, address information, and other profile information. User preferences may include mode of communication, order of communication, contact information and other preferences. User preference information may be associated with each security device, group of devices, systems or other combinations. For example, different alarm situations that may be detected in various locations or systems may warrant different levels of response. In addition, a user may maintain a personal address book where contact information (e.g., phone, pager, mobile device, etc.) associated with various individuals may be stored and accessed based on various identified alarm situations and/or potential alarm situations. Special instructions may include information to be conveyed to entities reacting to the alarm for a particular location or object. For example, when a fire detector is activated, the user may want to inform the fire department that the user has two pets living at the user's primary residence. Other instructions for different registered locations, objects and/or individuals may be stored and conveyed to entities reacting to the alarm situation per the user's instructions or preferences.

In another embodiment of the present invention, the functions described herein for central security server 130 may be provided in each security device and/or control panel. In that embodiment, each individual security device and/or control panel may initiate notification wirelessly directly to the user based on user notification preferences and data detected at the security device(s). Information from the individual security devices may still be transmitted to a central system to store as part of aggregate data discussed in more detail below.

Alarm events database 142 may contain historical alarm and/or other data. Alarm events database 142 may maintain data related to alarm events and other alarm worthy situations within a network and/or community. Other information may be stored and other sources of information may be accessed. This data may be used to generate reports based on aggregated data. For example, a user may request a report regarding home burglaries or other break-ins within a 10 mile radius of the user's primary home for the past 6 months. Other locations, time frames and factors may be identified in generating a report. Maps, charts and/or other graphics may be used to display historical alarm data based on user specifics.

Reports database 144 may contain a repository of user generated reports. These reports may be modified by the user at later times. Also, a user may request periodic updates on generated reports at predetermined intervals of time. Other information may also be requested.

Based on user information retrieved from one or more databases 140, 142, 144 and 146, central security network 130 may contact one or more users 160 or other identified contacts $\mathbf{162}_1$–$\mathbf{162}_N$ as specified by the user. Other identified contacts may include neighbors, family members, personal doctors, emergency entities 164, such as the police, fire department, hospital and others.

Figure 4:
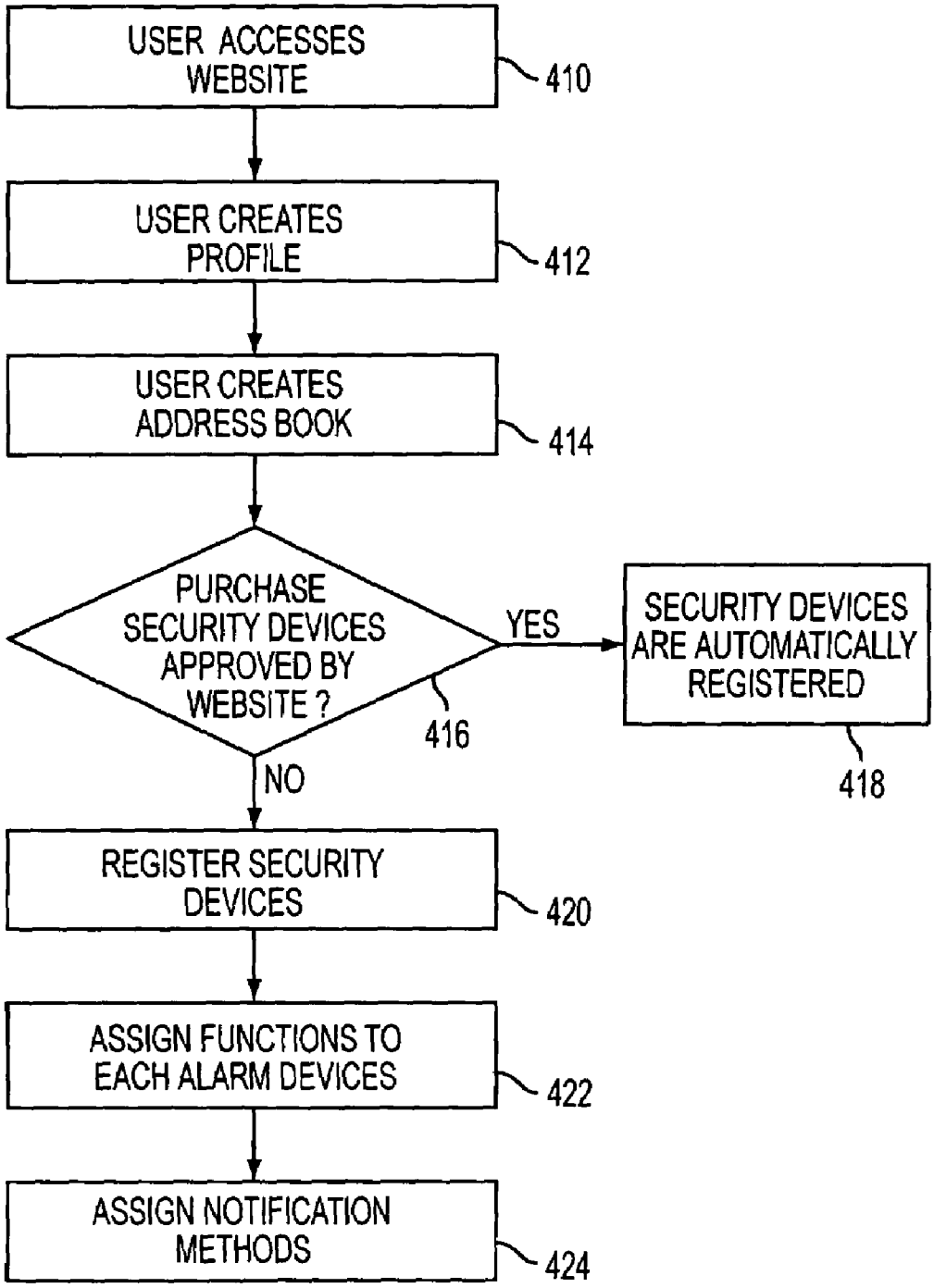
FIG. 4 is a flowchart illustrating a subscription process, according to an embodiment of the present invention.

FIG. 4 is a flowchart illustrating a subscription process, according to an embodiment of the present invention. At step 410, a user may access a web site of the present invention. At step 412, a user may create a profile with customized options. At step 414, a user may create a personalized address of contact information. At step 416, it may be determined whether security devices are purchased from the web site. If so, security devices may be automatically registered, at step 418. If not, security devices may be registered with a central security network, at step 420. At step 422, functions may be assigned to each alarm device or group of alarm devices. At step 424, notification methods may be specified. The steps of FIG. 4 will be described in further detail below.

As illustrated by step 410, a user may access a web site or other user interface associated with a central security network of the present invention. A user may create a subscription with an operation of a central security network by accessing an associated web site via Internet 150. Other methods of connecting the central security network may also be implemented (e.g., telephone registration, mail registration, etc.). The user may select a login and password or other secure access and information retrieval associated with the user. Other security features may also be implemented.

The user may create a profile, at step 412, which may include user identification information (e.g., name), address information, contact information (e.g., phone number, mobile phone number, etc.), email address, billing information and other information.

At step 414, a user may create an address book, which may include a collection of contact information for various individuals or entities identified by the user. For example, the user may provide contact information for various neighbors. In the event of a fire alarm, the present invention may notify the neighbors of the location at which a fire has been detected. In the event that an elderly family member hits a panic button, a family doctor may be contacted and given relevant information regarding the patient's current status.

The user may have the option of purchasing an entire customized security system and/or individual security devices from the present invention. At step 416, it may be determined whether security devices or security systems are approved by (e.g., purchased from) a central security network (or other authorized entity associated with the central security network). If so, security devices or systems purchased from the central security network (or other authorized entity) may be automatically registered with central security network, as illustrated by 418. The user may receive the security devices and install such devices without having to register them specifically.

Device packages offering different levels of security may be available for purchase on the web site or through an independent provider. A user may purchase devices a la carte, in predefined packages at varying levels of security, or any combination. For example, if an individual purchases a system (individual device or combination of devices) from the web site, the system (individual device or combination of devices) may be automatically registered to that user.

If the user has an existing security system or devices or purchased such devices and/or systems from other entities, the user may register these security devices and/or systems, at step 420. For example, the user may register each security device, system or other combination for each property (e.g., house, business, vacation house, etc.), personal property (e.g., car, boat, mobile home, etc.), individual (e.g., spouse, child, grandparent, etc.) and others. For each identified property, personal property, individual or other, the associated security devices may be registered, at step 420.

For example, within a house, a user may have window and door contacts, smoke detectors and motion sensors, video cameras, key chain control, temperature monitors, CO and other gas detectors, vibration sensors, and others. A user may have flood sensors and other detectors on a boat. An individual, such as an ill or elderly grandparent, may have access to a panic transmitter or other alarm transmitter. Other sensors and/or detectors may also be included. The user may register security devices on a central security network by entering the identification code for each registered device and/or system. Other methods of identifying devices, control panels and systems may also be used.

Thus, the central security network of the present invention may also support users who already have an alarm system in their home, or want to buy a system from an alarm dealer and have it professionally installed. The central security network of the present invention may serve as a primary, secondary or other monitoring service.

At step 422, the user may assign various functions to each security device associated with each security system for property, personal property, individuals and others. A user may identify various alarm situations which may include fire (e.g., detected by a smoke alarm), intrusion or break-in (e.g., detected by motion sensors, window contacts, door contacts, etc.), tampering with valuables held in a safe or vault (e.g., detected by vibration sensor, motion sensors, contacts, etc.), assault or danger (e.g., detected by panic button, etc.), dangerous gas levels (e.g., detected by CO or other gas detector, etc.), and other alarm situations or alarm worthy situations.

The user may also request to receive network alerts. Network alerts may be based on alert notifications associated with property, personal property and/or individuals within a defined area or locality. For example, a user may request to receive alert notification that a house in the user's neighborhood was burglarized. This notification may be conveyed in an email or other personalized method of notification. Other variations and options may be implemented.

At step 424, the user may identify notification specifics for each alarm or group of alarms for each system (e.g., property, personal property, individual, etc.). For example, notification specifics may include the methods of notification desired, the order of notification, a list of individuals and/or entities to be notified and other notification information. For example, in the event of a burglary or break-in, the user may request to be notified via cell phone (or other mobile device) where the system may continuously dial the cell phone number until the user answers to respond to the alarm. The user's response may include confirmation of the alarm event, cancellation of the alarm, and other action. The user may also specify that the system should attempt to contact the user through various forms of communication until an answer is received.

In addition, a user may indicate an order of notification or priority. For example, if a user (or owner) cannot be reached, the system may be instructed to contact the next contact entity on the user's order of notification, such as a spouse, relative or neighbor.

A user may also assign various methods of notification for each alarm event or group of alarm events. Methods of notification may include cell phone, regular phone, pager, PDA, email, instant messenger, or other form of communication.

Users may also have the option of inserting comments to be passed on to the authorities (or other emergency entity) should the central security network need to contact them. For example, if an ailing or elderly person hits their panic button, the central security network may call 911 (or other emergency unit) and pass on pertinent health information.

Figure 5:
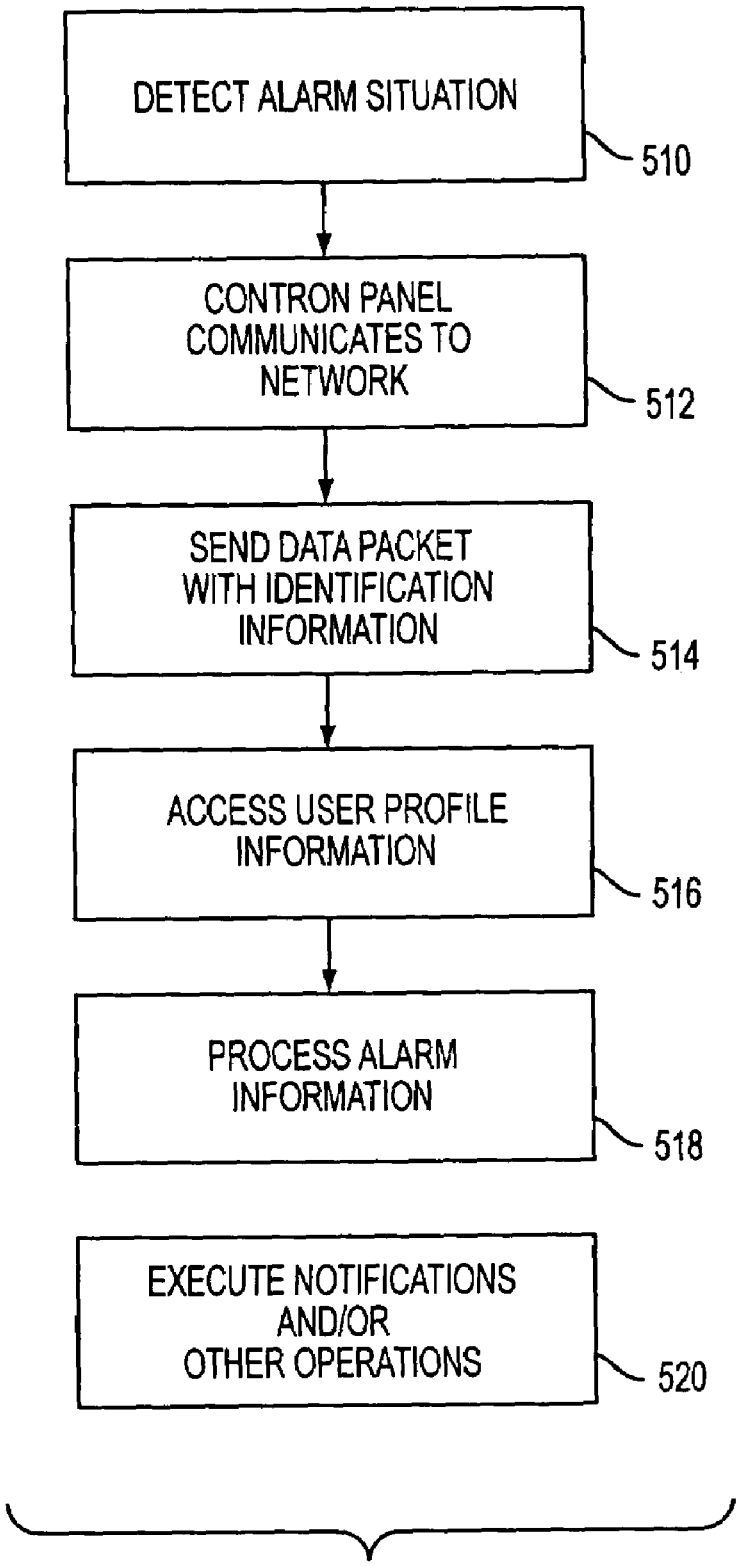
FIG. 5 is a flowchart illustrating an alarm activation process, according to an embodiment of the present invention.

FIG. 5 is a flowchart illustrating an alarm activation process, according to an embodiment of the present invention. Wireless and other sensors may send status information to a local control panel. An alarm situation may be detected by one or more sensors, at 510. The local control panel may communicate to a central security network of the present invention, at step 512. Communication may be established via radio modems, landlines (e.g., phone, cable, etc.), wireless (e.g., cellular, etc.), satellite and/or other methods of communication. The alarm situation and other information may be conveyed via one or more data packets, as shown by step 514. At step 516, the central security network of the present invention may query one or more user databases to access user information. At step 518, the alarm situation received by the central security network may be processed according to user-defined conditions and/or other information. The central security network of the present invention may then execute notifications and/or other information to one or more identified entities in the manner identified by the user and other relevant factors and data, as illustrated by step 520.

According to another embodiment of the present invention, a wireless communication device at a home security system may relay a direct wireless communication from a home security device to a user's mobile device (e.g., cell phone, pager, PDA, etc.). This feature of the present invention may ensure communication to the user via wireless communication in the event of power failures and other power cutoffs.

A control panel may communicate with a central security network via various types of connections. The control panel may have a built-in modem or other communication device. A data packet (or other form of information) may send various types of relevant information, such as one or more of identification number of the control panel, identification number of the device issuing the alarm, relevant information regarding the nature of the alarm, photos, video clips, images and/or other information to one or more receiving servers at the central security network. Upon receiving this data, the central security network may query a user (or other) database where the device ID may be associated with pertinent user information, including one or more of user's profile, preferences and/or permissions. Other relevant information may also be retrieved or made available. By retrieving this information, the central security network may determine how the system should react given a specific user and a specific type of alarm (e.g., smoke, motion, panic, etc.).

For example, when a smoke alarm goes off, a user may instruct a central security network to first contact the user's home to verify the alarm. If no one is home or the emergency situation was confirmed by someone at home, the central security network may directly contact a local fire department and provide the location, nature and/or other information related to the emergency. In addition, the central security network may notify the user's identified neighbors that they may be in danger in the event of an emergency, such as a fire alarm. A different set of conditions may apply if an aging relative with a heart condition activates a panic button or if an intruder were detected in the user's bedroom. Thus, a user may customize a response to an alarm situation or potential alarm situation, depending on various factors, such as the user's preferences, special needs and other relevant factors.

Alarm responses (e.g., alarm sound, emergency dispatch, notifications, etc.) may be based on user preferences and/or other factors and information. For example, an alarm may be activated at the detection of an alarm situation or after confirmation by the user. Also, the user may specify when emergency dispatch is to occur. For example, emergency dispatch may occur at the detection of an alarm situation, after confirmation by the user, after a predetermined period of time if the user cannot be reached or other user defined event or trigger. Thus, the present invention may assist the user in minimizing the penalties and fines associated with false alarms.

Figure 6:
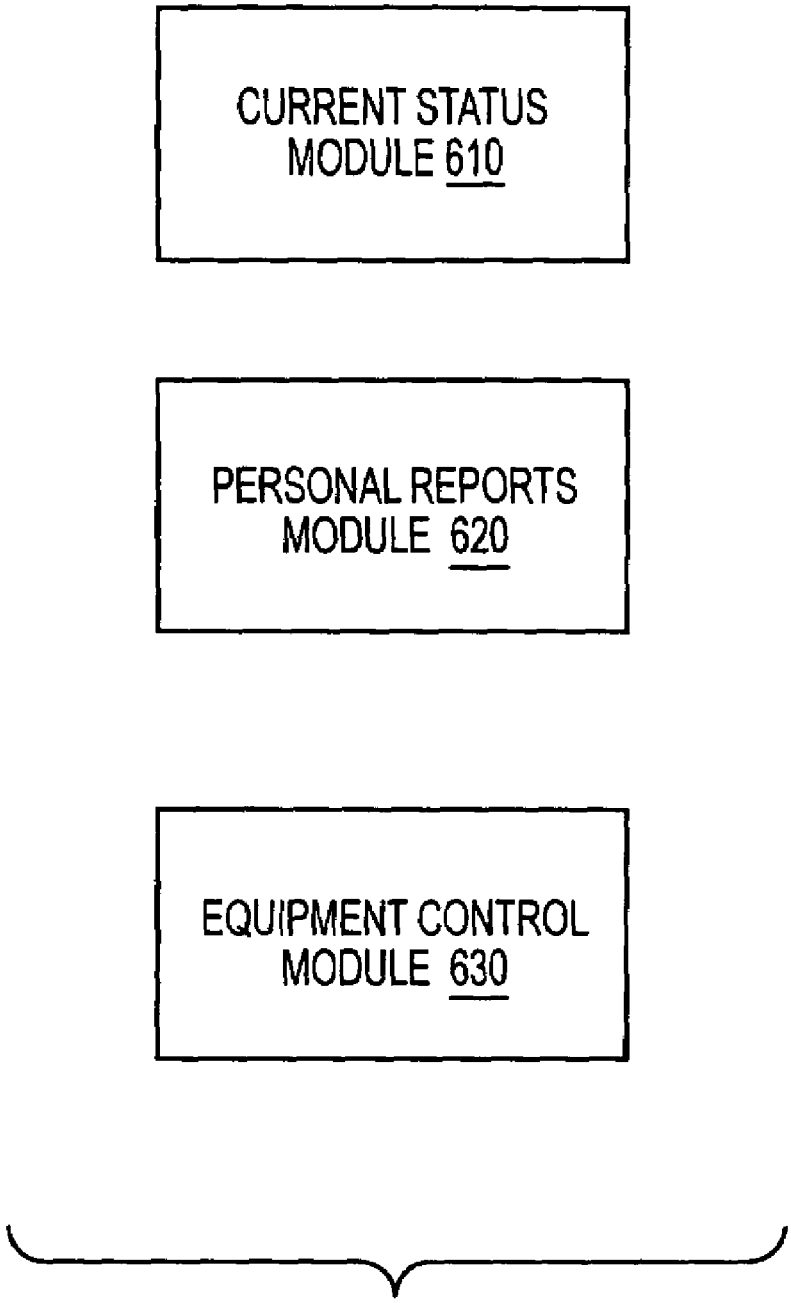
FIG. 6 is an example of a personal status page, according to an embodiment of the present invention.

FIG. 6 is an example of a personal status page, according to an embodiment of the present invention. A user of the present invention may access a web site (or other user interface) through the Internet or other communication means. A user may also access the network via a voice portal where information may be communicated to the user in a voice message. For example, a user may access a personal status page where personal information may be observed and analyzed. The personal status page may include various modules and functions, which may include a current status report module 610, personal reports module 620, equipment control module 630, and other modules and functions.

Current status report module 610 may enable a user or other authorized individuals or entities to view current security information for one or more registered security devices and/or systems. The current status page may include a current status report, showing each device on a system or network, device status and any relevant information about that device. For example, a user may select to view current information for an identified device, such as a motion sensor, at an identified location (e.g., house). An identified device may include motion sensors, door contacts, window contacts, etc. An identified location may include one or more of a house, office, vacation home, car, boat, family members or other individuals, and others. Summary information may be provided for situations that may be identified as alarm worthy events. This information may be personalized by the user. Further detailed information may be viewed for identified alarm situations and others. Detailed information may include video footage, photographs and other data.

Figure 7:
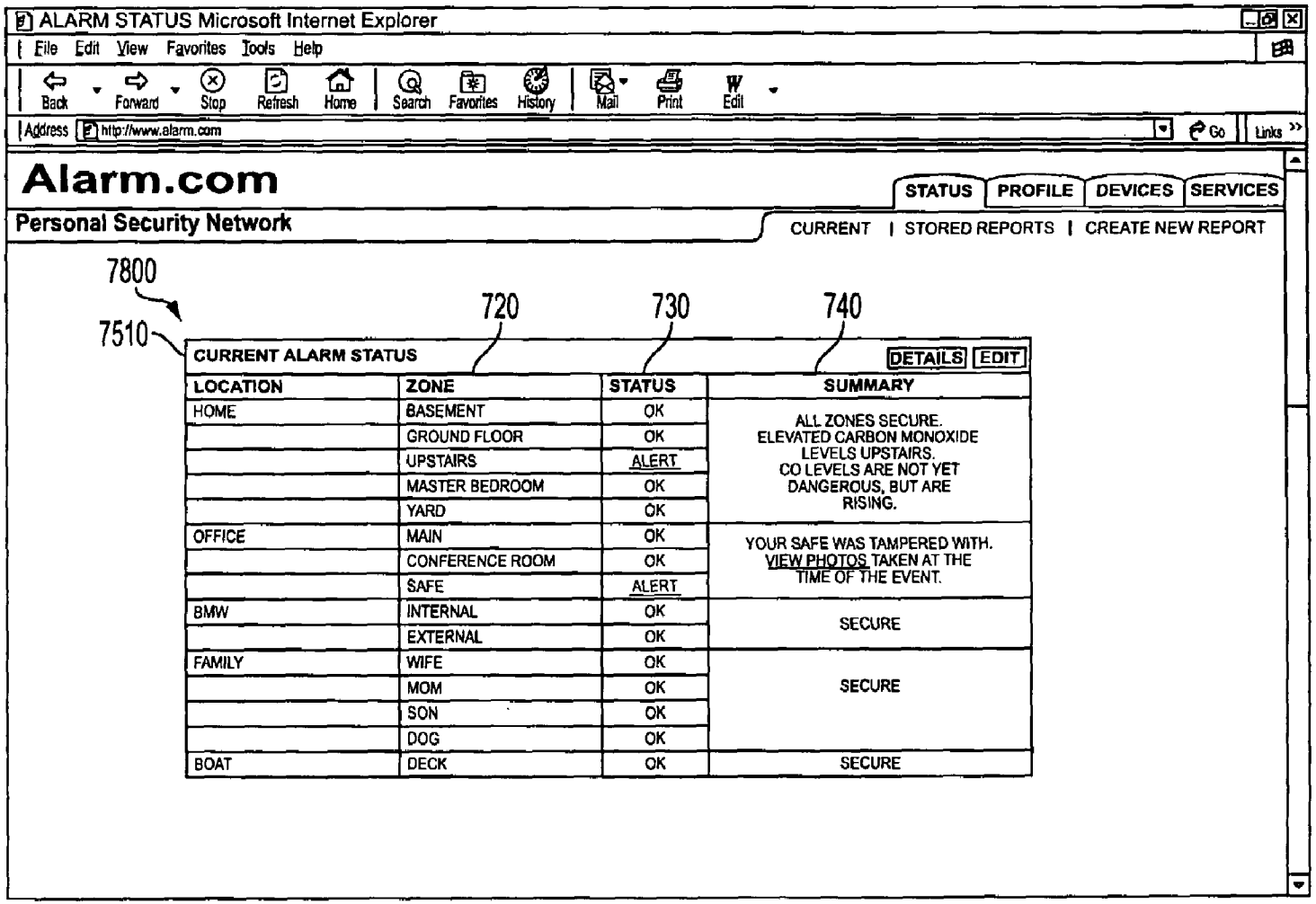
FIG. 7 is an example of a current status report, according to an embodiment of the present invention.

An example of a current status report may be illustrated in FIG. 7. Report 700 is an example of a personalized current status report for a user as may be viewed from a web site. It should be appreciated that when a web-based example is used, other user interfaces may also be used including telephone interfaces, mobile web, PDAs, etc. For example, location column 710 may list one or more locations that have been registered with the central security network of the present invention. For example, locations may include home, office, car, family members and other individuals, and boat. Other locations, objects, individuals may be registered with the system of the present invention. Zone 720 may list one or more areas monitored by one or more security devices.

The zone definitions may be identified and/or personalized by the user. For example, a zone may include an area within an identified location. For example, for the home location, zones 720 may include one or more of basement, ground flood, upstairs, master bedroom, and yard. Zones may also be defined by the user, depending on the number and monitoring capabilities of security devices within a location. Zones may also be defined as the area and/or events covered by a single device or group of security devices. For example, zones may be defined as front door, back door, garage door, basement door, windows (first level), windows (second level), etc. Other zones may be defined as fire, flood, temperature, gas, etc. Thus, a user's ability to monitor may be more detailed or broader in scope, depending on the user's preferences, user-defined zones and other information.

For each identified zone or group of zones within a location, current status information may be displayed. Current status information may include whether an alarm situation has been identified. For example, terms, phrases, symbols, and/or identifiers may be used to warn the user of an alarm situation or other alarm worthy events, as defined by the user. Different terms, phrases, symbols and/or identifiers may be used to indicate varying degrees of severity.

For example, when an alert situation is detected, the status column 730 may indicate such an event to the user. In the example of FIG. 7, the term "ALERT" may be displayed. By clicking on or otherwise selecting the alert notification entry in column 730, the user may receive details regarding the alert. Details regarding the alert notification may also be displayed in summary column 740. For example, the user may be informed that a safe was tampered with. The user may also have the option to view photographs and/or video clips at the time of the alarm incident. Other detailed information may be provided. For example, icons or other images may indicate status information, such as alarm, open, tampering, no AC power, shut, sensor bypassed, battery low, siren if alarm, contact if alarm, monitor and other status data for each sensor, group of sensors, for example.

In another example, the user may be informed that all zones are secure and that elevated levels of carbon monoxide have been detected in the upstairs zone of the user's home, where CO levels are rising but not yet dangerous. Other detailed information may be viewed by accessing the alert notification (e.g., clicking on the term "ALERT"). For example, the user may view CO level readings and the relation of current CO levels with levels that may be considered harmful. The user may also access preventive information, which may include instructions, contact information and other information to enable the user remedy the alert situation.

Other events may also be reported and tracked. For example, a user may generate reports for event types, such as the opening of the kitchen door, garage door, for example. Other actions and events may be tracked. Details and other data may be provided, such as date and time of the occurrence. Thus, a detailed log of events detected by security and other devices may be reported and tracked at user defined levels of detail. For example, a user may select or identify report factors, which may include type of event, type of device, unit or system, time period(s), display order, and/or other details. Type of event may include off, tripped, value, fire, battery, AC, malfunction, tamper, disarming, arming stay, arming away, arming failed, disarming failed, sensor bypassed, programming, open and others. Type of device may include smoke, heat, CO, radon, temperature, contact, motion, camera, breakage, sound, panic button, control, light and others.

In addition to the current status report, a user may generate personal reports for informative and precautionary purposes. Personal reports module 620 enable a user or other authorized individuals or entities to generate reports based on current and historical security information from one or more entities registered with the central security network of the present invention. Personalized reports may be generated based on variables, such as time and location. For example, a user may want to view a report showing motion detected in the yard (the location) over the past month (the time).

In another example, a user may request reports based on aggregate data. Aggregate data may include data and/or statistics from other sources within the central security network of the present invention. The user may want to view more general reports derived from the entire network, not just the user's own system. For example, a user may generate a report based on the break-ins within a 5 mile radius of the user's home address within the last 6 months. Other data and demographics may be used to display various graphs, chart, reports and other formats for analysis. An example of a network-dependent report may include a map (or other graphic) showing all of the burglaries that have taken place within 10 miles (or other distance) of the user's home (or other identified location) within the last six months (or other time period or event). Detail information for each alert event may also be provided. For example, a fire icon may represent a fire accident within a user defined location. Further details regarding the exact location of the fire, when the event occurred, police reports and other relevant data may be presented. Links to news bulletins, prevention data and other information may be provided as well. In addition, users may generate and save customized reports to be accessed through the web interface of the present invention. In another example, a user may request a map where recent assaults have occurred in or near the user's neighborhood in the last 3 months.

According to an embodiment of the present invention, the user may aggregate security and/or other data from various sources (e.g., external sources) to generate customized reports regarding issues of concern. Other sources of information may include public records, police reports and other data. This feature of the present invention provides users (and/or other authorized individuals and/or entities) the ability to analyze data on varying levels of detail and user-defined factors.

Figure 8:
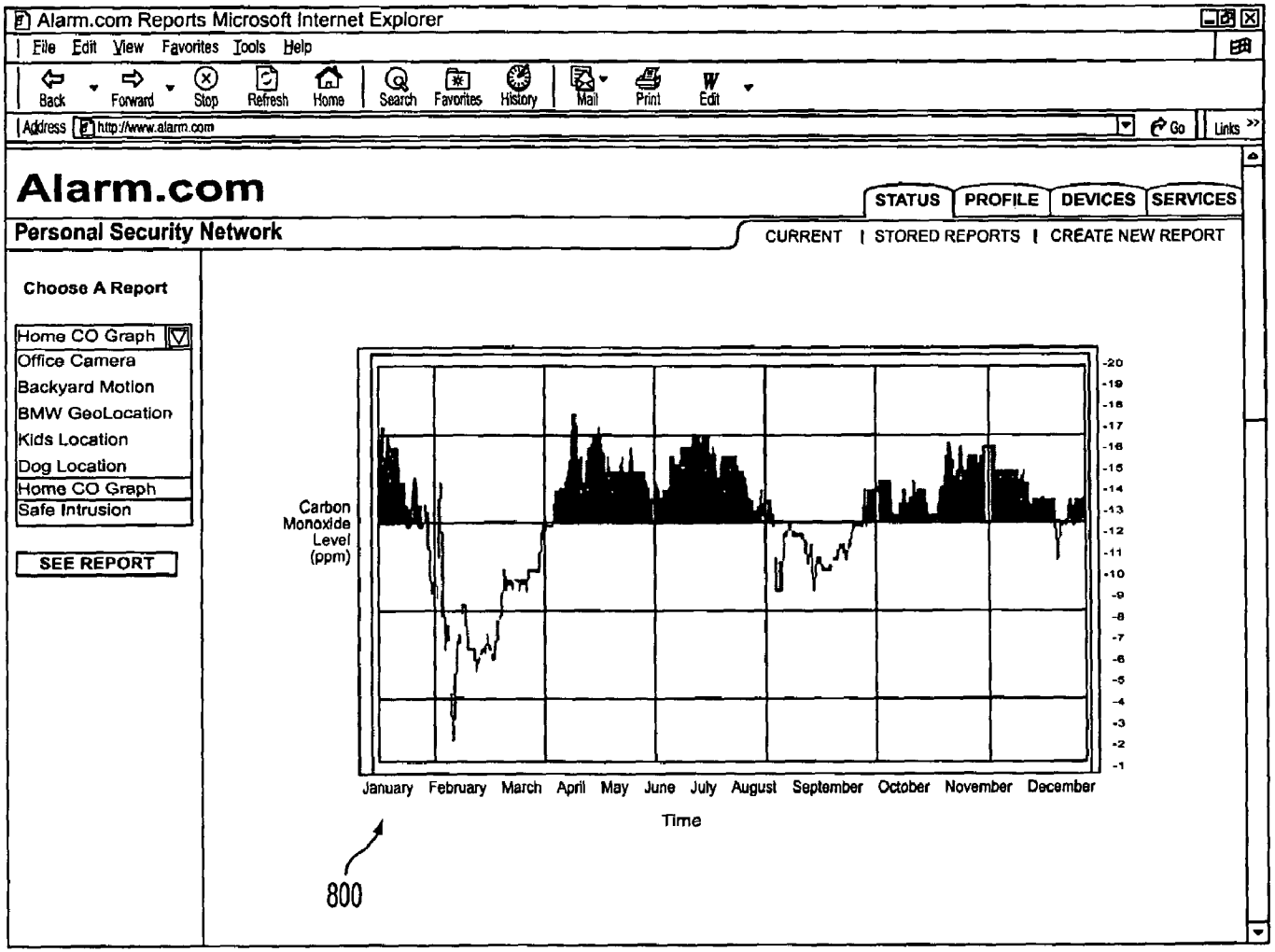
FIG. 8 is an example of a personal report based on current, historical and other data, according to an embodiment of the present invention.

FIG. 8 is an example of a personal report based on current, historical and other data, according to an embodiment of the present invention. For example, a user may generate various reports, such as a home CO graph, office camera, backyard motion, car location, individual location, pet location, and safe intrusion, for example. Data regarding other events under surveillance by the user may be used to generate other user-defined graphs, charts and other formats of data.

In another example, the user may request scheduled services which may include a generation of regular reports about selected security issues or status information. For example, a user may request a report of local break-ins which may be generated and conveyed to the user at pre-determined intervals, such as every week. Reports may also be generated at the occurrence of a triggering event, such as an alarm situation. For example, at the occurrence of a police response to an alarm, the system may generate an updated report including the most recent police response or other identified trigger within the user's defined area of interest. Other triggers and user-defined preferences may be defined.

Equipment Control module 630 may enable a user to control various appliances and devices within a user's home or other location. For example, devices may include lights, televisions, VCRs, heating, ventilation, air conditioning, home entertainment units and other devices. Appliances may include stove, gas range, iron, and others. Through the present invention, the user may control these appliances and devices remotely. For example, while the user is away on an extended trip, the user may want the user's home to appear "lived-in." Thus, the present invention enables users to control appliances, devices and other objects remotely so that potential intrusions and/or burglaries may be avoided. For example, this feature of the present invention may also include the ability to turn devices on and off and manipulate lighting in the home or other location. The present invention may also enable the user to implement a schedule at which to activate one or more devices. For example, the heating may be turned on every morning at 6:00 a.m. and turned off every night at 10:00 p.m., as defined by the user's schedule. Also, the porch lights may be activated every night at 6:00 p.m. and turned off at 6:00 a.m.

Figure 9:
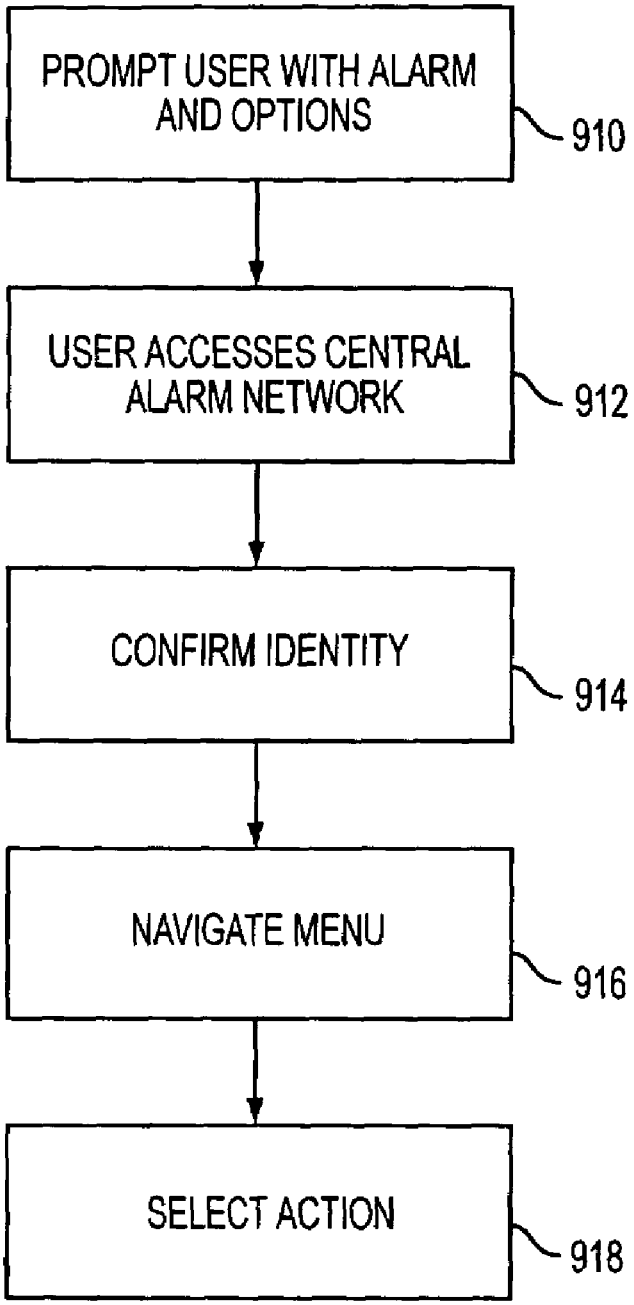
FIG. 9 is a flowchart illustrating a process for accessing a security system, according to an embodiment of the present invention.

FIG. 9 is a flowchart illustrating a process for accessing a security system, according to an embodiment of the present invention. At step 910, a user may be presented with an alarm notification and various options. The user may be notified via pre-selected methods of communication. For example, the user may request to be notified via pager, cell phone or other form of wireless and other communication. For example, the user may receive a notification with options where the options may include notifying a spouse, notifying neighbors and other options. At step 912, a user may access a central security network of the present invention, via various forms of communication, such as WAP, Internet, voice portal and other methods. At step 914, the user may be asked to confirm the user's identify for access authorization. For example, the user may be asked to provide a password, PIN or other form of identification. This information may be checked against the user's database and/or other subscriber information.

At step 916, the user may be permitted to navigate through the option menus to retrieve relevant and important information. Depending on the medium of communication (e.g., wireless, voice, Internet, etc.) the user may navigate through possible choices via voice, keypads, number selection and other selection methods. For example, a user may be alerted via a mobile device (e.g., a cell phone) that an intruder has been detected at the user's home. Menu options may include selecting (e.g., pressing or saying) 1 to alert the authorities; selecting 2 to deactivate the alarm, and other options. In another example, a user may be alerted that an attempted burglary took place on the user's street last night. Menu options may include selecting 1 to notify the user's wife, selecting 2 to check the user's alarm system status and other options. Menu options may be predetermined based on user profile and other data. Menu options may also vary on the type of alarm event detected.

The present invention enables a user to monitor and automate home, business and other locations or objects from a remote location via a voice portal. For example, a user may perform various options, including the ability to arm and disarm security system and/or individual devices, turn lights on and off, and check current system status. The security service of the present invention allows a user to interact with a security system via voice messages. Voice shortcuts may also be created to enable users to punch in a code (e.g., 2 digit code) assigned by the user for certain tasks. For example, code 77 may turn off bedroom lights, code 78 may disarm the security system, and 79 may turn on the coffee maker. Features are customizable to a user's schedule and needs.

At step 918, the user may select the appropriate one or more actions. For example, the user may be notified of a possible break-in. The user may then select to view an image (e.g., photo, video, etc.) taken of the area associated with the alert at the time of the possible break-in. The user may then execute an appropriate action. For example, if the user views an image of a pet knocking over a lamp which falls and breaks a window, the user may cancel the alarm and emergency notification. Thus, police resources may be conserved and the user may avoid a penalty fine for a false alarm. Other actions may include a confirmation response where the user may confirm the emergency thereby allowing police (or other emergency) dispatch. The user may also provide feedback or request further information. Other options may also be available. To provide the functionality of a telephone-based output with user interaction, a voice delivery system, such as Microstrategy's Telecaster™ system, may be employed.

Figure 10:
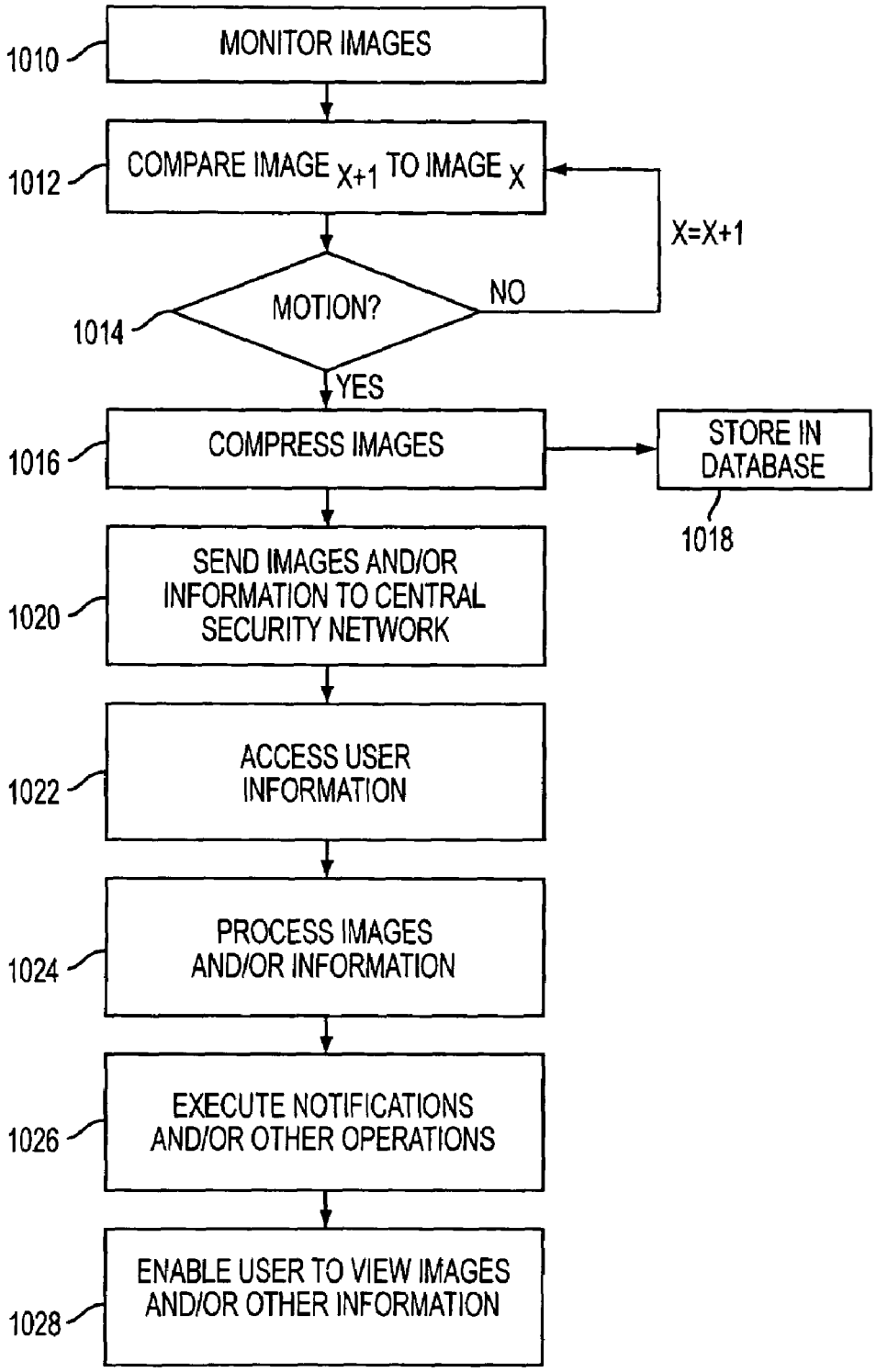
FIG. 10 is a flowchart illustrating a process for accessing video images provided by a security system, according to an embodiment of the present invention.

FIG. 10 is a flowchart illustrating a process for accessing video images provided by a central system network, according to an embodiment of the present invention. Users may monitor an identified location by using video or other similar recording device. The video feature of the central security network of the present invention may compare images. For example, if a change between images is detected, a recording may be triggered. The video clips of movement may be stored or sent to a server of a central security network. The user may then be notified according to predefined notification methods.

At step 1010, an identified location may be monitored by a video or other recording device. At step 1012, video images may be compared to detect motion or other event. For example, an image taken at time X+1 may be compared to a previous image taken at time X. The interval of comparison may be predetermined. In addition, the interval of comparison may be defined based on various factors, such as the importance of the property being monitored. For example, if motion is detected, an alarm may be triggered. In addition, the recorded images (e.g., video clips) may be compressed, at step 1016, to reduce the amount of data that may be stored in a database, as shown by step 1018, and/or sent to a central security network, as shown by step 1020. At step 1022, user information may be accessed to determine an appropriate response. For example, user information may include user profile, preferences, permissions and/or other information. At step 1024, the image (e.g., video clips) may be processed to determine whether certain user defined conditions are met for alarm triggers and other actions. Notifications and/or other actions may be executed at step 1026. At step 1028, the user may view video clips, images and/or other information remotely via various forms of communication, including wireless devices or the image may be automatically transmitted to the user at a selected device.

Figure 11:
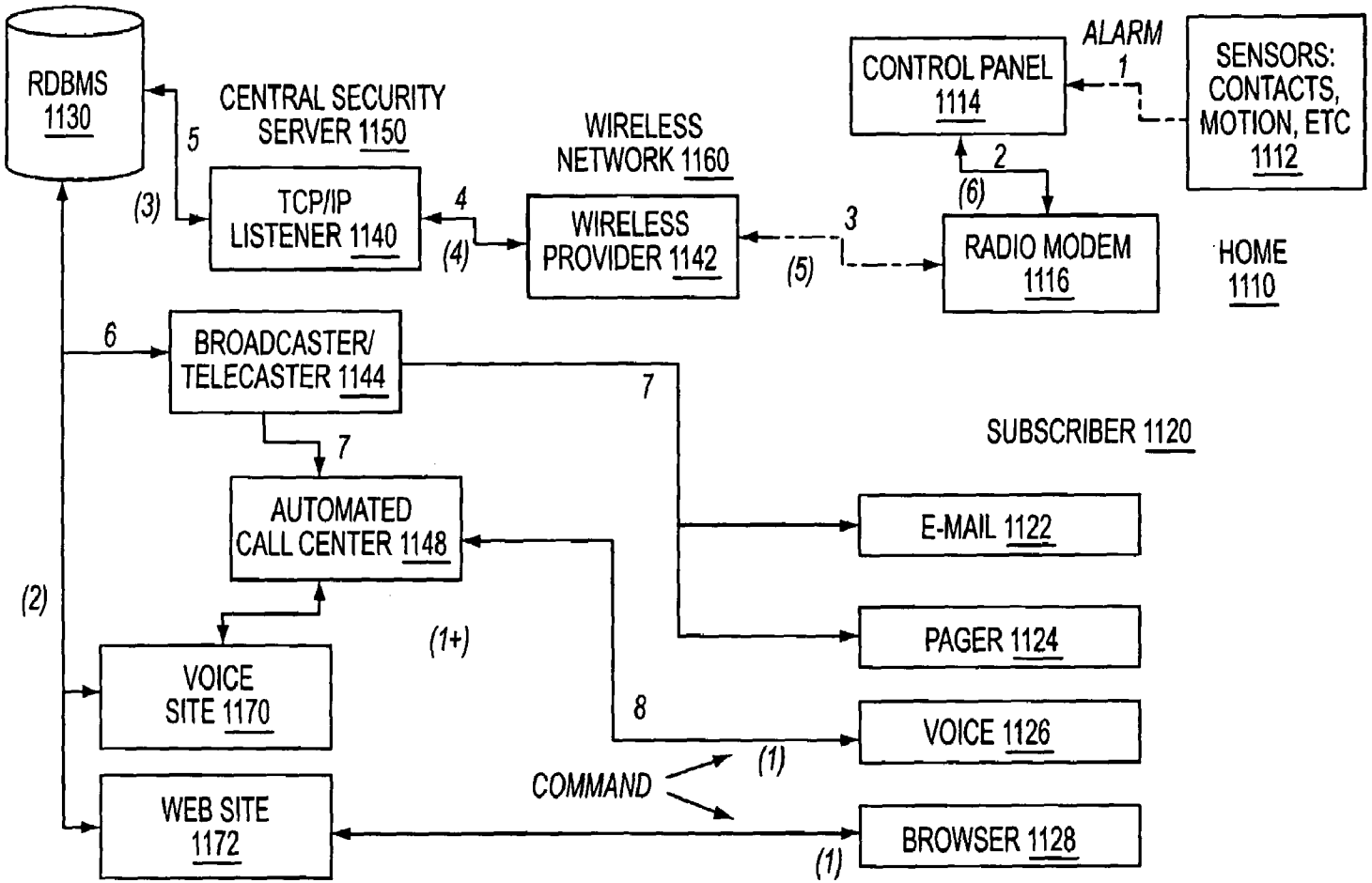
FIG. 11 is an example of an alarm flow diagram, according to an embodiment of the present invention.

FIG. 11 is an example of an alarm flow diagram, according to an embodiment of the present invention. Alarm and other data may be transmitted from a location, such as home 1110, to subscriber 1120 or other identified entities via central security server 1150. Data from subscriber 1120 may also be communicated to home devices via central security server 1150. Wireless communication with home 1110 may be established via wireless network 1160, which may include a wireless provider 1142 for wireless notification and user interaction.

For alarm notification, security devices 1112, such as sensors, contacts, motion detectors, etc., may transmit alarm data to control panel 1114. Other devices may also be implemented for monitoring and other functions. For example, security and other devices may transmit data to control panel 1114 to indicate events, such as a door or window opening and/or closing. Other events may be monitored. Control panel 1114 may then transmit alarm and/or other data to radio modem 1116. Radio modem 1116 may wirelessly transmit data via a wireless provider 1142 to establish communication with central security server 1150. Wireless data may be transmitted to TCP/IP listener 1140, which may then communicate relevant data via relational database 1130. Profile and other data from database 1130 may then be transmitted to Broadcaster 1144 for the automatic generation of personalized output from an on-line analytical processing system, according to the functionality provided in U.S. Pat. No. 6,154,766, which is directed to Broadcaster™ provided by Microstrategy™. For electronic notification, data may be transmitted to subscriber 1120 via e-mail 1122, pager 1124 and other formats.

According to another embodiment of the present invention, voice alerts may be provided via Microstrategy Telecaster™ 1144, which proactively delivers personalized information from a data warehouse to a voice receiver, such as a cell phone, telephone, etc. Telecaster 1144 may transmit personalized voice data to Automated Call Center 1148 which then provides a voice message to a voice enabled device, as illustrated by 1126. The transmitted voice data may be interactive to enable the subscriber to respond to the voice data, via voice, keypad or other format.

In addition, subscriber 1120 may initiate a command, request monitor data, report data and other information via Browser 1128. For example, subscriber 1120 may view monitor and other data, submit requests and perform other operations via web site 1172 provided by central security server 1150. In addition, subscriber 1120 may submit a voice request, as illustrated by voice 1126, which may be accepted by Automated Call Center 1148 where voice messages may be sent or retrieved via voice site 1170. Status data, monitor data and other information may be accessed from database 1130. In addition, commands, such as activate alarm, turn off lights, etc., may be verbally or otherwise communicated to voice site 1170. User requests and other data may be transmitted from voice site 1170, web site 1172 and other user interface to database 1130 where user profile data and other relevant information may be retrieved.

If an action is requested by subscriber 1120, central security server 1150 may forward the request data to an identified location, such as home 1110, via TCP/IP listener 1140. A wireless request or other data may be transmitted via wireless provider 1142 to radio modem 1116. Control panel 1114 may then carry out the user's request, which may include an activation request and/or other operations.

Figure 12A:
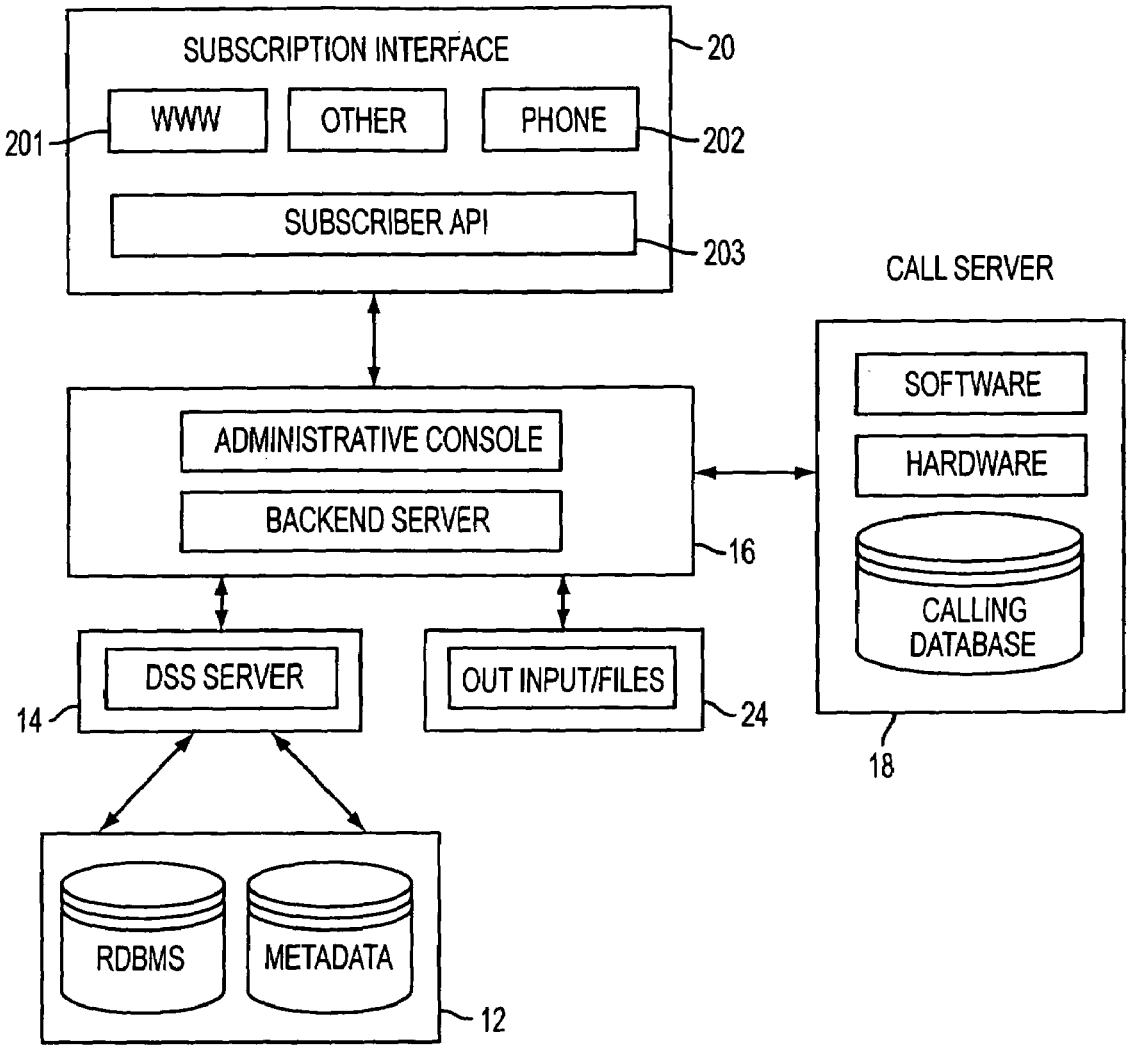
FIG. 12*a* is a schematic block diagram of a voice system, according to an embodiment of the present invention.
Figure 12B:
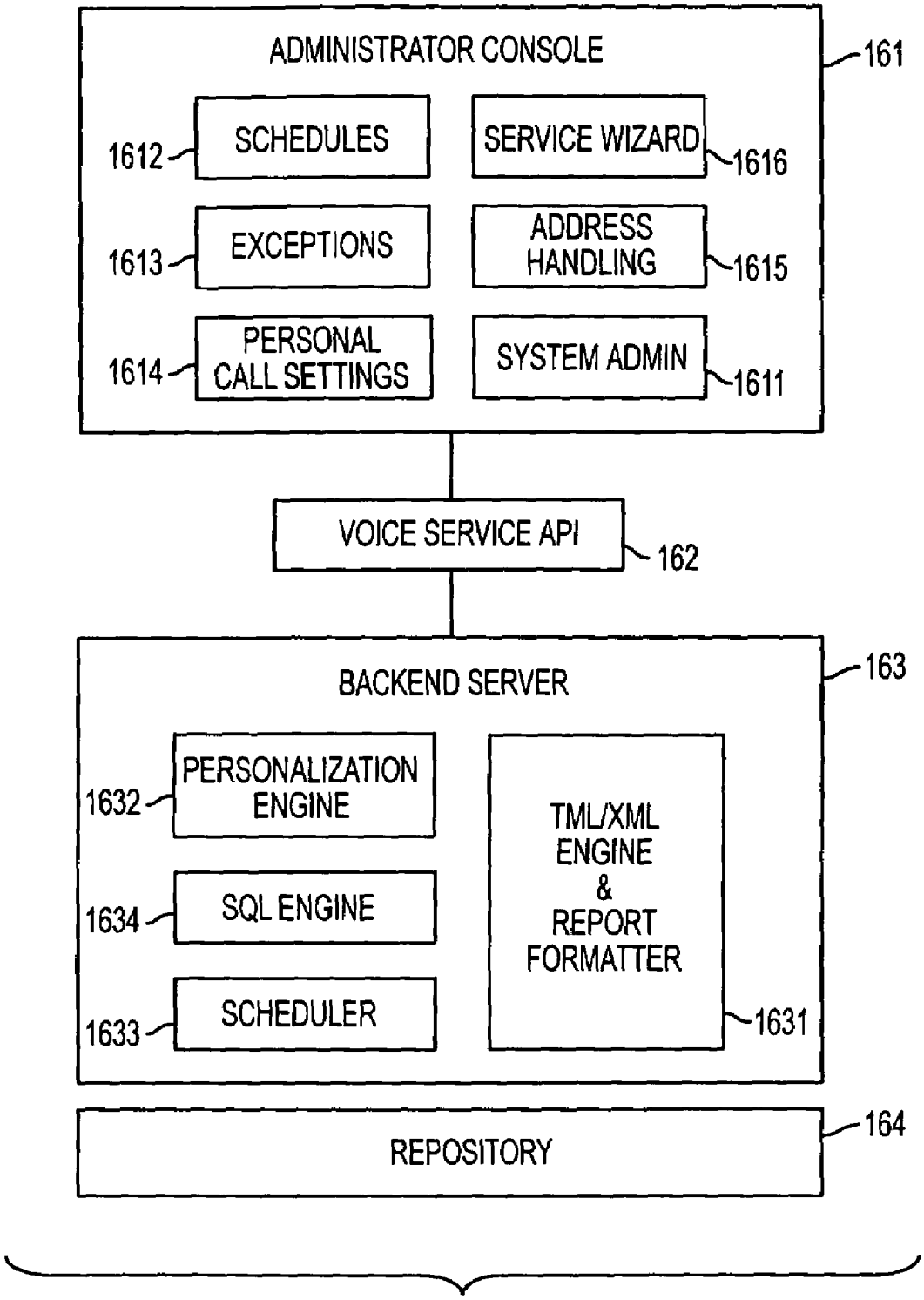
FIG. 12*b* is a schematic block diagram of an intelligence server, according to an embodiment of the present invention.
Figure 12C:
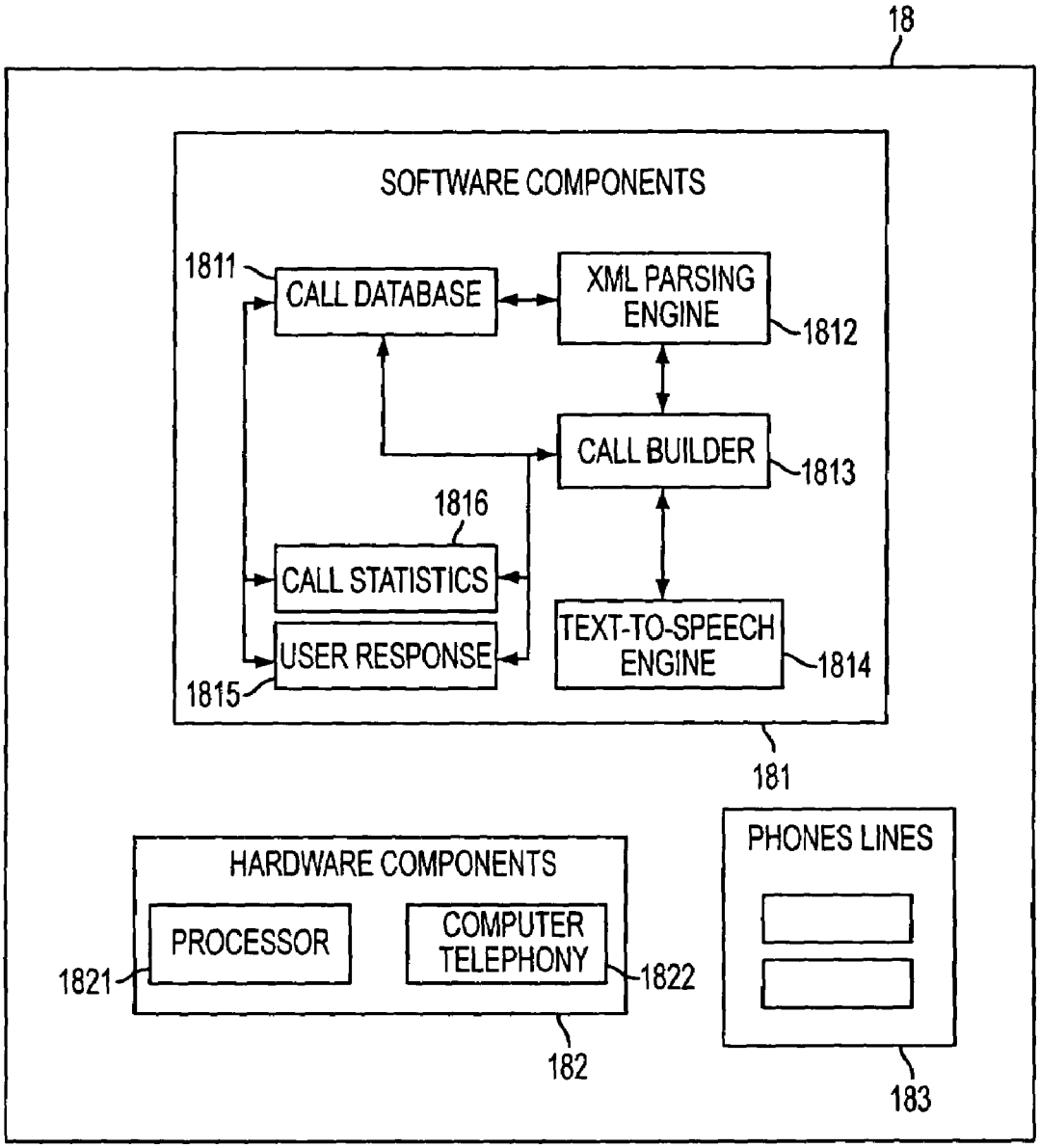
FIG. 12*c* is a schematic block diagram of call server, according to an embodiment of the present invention.

According to the functionality provided in FIGS. 12*a*–12*c*, the system of the present invention provides deployment of personalized, dynamic and interactive voice services.

FIG. 12*a* depicts an embodiment of a voice system, according to an embodiment of the present invention. Preferably, the system comprises database system 12, a DSS server 14, voice service server 16, a call server 18, subscription interface 20, and other input/files 24.

Database system 12 and DSS server 14 comprise an on-line analytical processing (OLAP) system that generates user-specified reports from data maintained by database system 12. Database system 12 may comprise any data warehouse or data mart as is known in the art, including a relational database management system (RDBMS), a multidimensional database management system (MDDBMS) or a hybrid system. DSS server 14 may comprise an OLAP server system for accessing and managing data stored in database system 12. DSS server 14 may comprise a ROLAP engine, MOLAP engine or a HOLAP engine according to different embodiments. Specifically, DSS server 14 may comprise a multithreaded server for performing analysis directly against database system 12. According to one embodiment, DSS server 14 comprises a ROLAP engine known as DSS Server™ offered by MicroStrategy.

Voice service server (VSS) 16, call server 18 and subscription interface 20 comprise a system through which subscribers request data and reports e.g., OLAP reports through a variety of ways and are verbally provided with their results through an interactive voice broadcast (IVB). During an IVB, subscribers receive their requested information and may make follow-up requests and receive responses in real-time as described above. Although the system is shown, and will be explained, as being comprised of separate components and modules, it should be understood that the components and modules may be combined or further separated. Various functions and features may be combined or separated.

Subscription interface 20 enables users or administrators of the system to monitor and update subscriptions to various services provided through VSS 16. Subscription interface 20 includes a world wide web (WWW) interface 201, a telephone interface 202, other interfaces as desired and a subscriber API 203. WWW interface 201 and telephone interface 202 enable system 100 to be accessed, for example, to subscribe to voice services or to modify existing voice services. Other interfaces may be used. Subscriber API 203 provides communication between subscription interface 20 and VSS 16 so that information entered through subscription interface 20 is passed through to VSS 16.

Subscription interface 20 is also used to create a subscriber list by adding one or more subscribers to a service. Users or system administrators having access to VSS 16 may add multiple types of subscribers to a service such as a subscriber from either a static recipient list (SRL) (e.g., addresses and groups) or a dynamic recipient list (DRL) (described in further detail below). The subscribers may be identified, for example, individually, in groups, or as dynamic subscribers in a DRL. Subscription interface 20 permits a user to specify particular criteria (e.g., filters, metrics, etc.) by accessing database system 12 and providing the user with a list of available filters, metrics, etc. The user may then select the criteria desired to be used for the service. Metadata may be used to increase the efficiency of the system.

A SRL is a list of manually entered names of subscribers of a particular service. The list may be entered using subscription interface 20 or administrator console 161. SRL entries may be personalized such that for any service, a personalization filter (other than a default filter) may be specified. A SRL enables different personalizations to apply for a login alias as well. For example, a login alias may be created using personalization engine 1632. Personalization engine 1632 enables subscribers to set preferred formats, arrangements, etc. for receiving content. The login alias may be used to determine a subscriber's preferences and generate service content according to the subscriber's preferences when generating service content for a particular subscriber.

A DRL may be a report which returns lists of valid user names based on predetermined criteria that are applied to the contents of a database such as database system 12. Providing a DRL as a report enables the DRL to incorporate any filtering criteria desired, thereby allowing a list of subscribers to be derived by an application of a filter to the data in database system 12. In this manner, subscribers of a service may be altered simply by changing the filter criteria so that different user names are returned for the DRL. Similarly, subscription lists may be changed by manipulating the filter without requiring interaction with administrator console 161. Additionally, categorization of each subscriber may be performed in numerous ways. For example, subscribers may be grouped via agent filters. In one specific embodiment, a DRL is created using DSS Agent™ offered by MicroStrategy.

VSS 16 is shown in more detail in FIG. 12*b*. According to one embodiment, VSS 16 comprises administrator console 161, voice service API 162 and backend server 163. Administrator console 161 is the main interface of system 100 and is used to view and organize objects used for voice broadcasting. Administrator console 161 provides access to a hierarchy of additional interfaces through which a system administrator can utilize and maintain system 100. Administrator console 161 comprises system administrator module 1611, scheduling module 1612, exceptions module 1613, call settings module 1614, address handling module 1615, and service wizard 1616.

System administrator module 1611 comprises a number of interfaces that enable selection and control of the parameters of system 100. For example, system administrator module 1611 enables an administrator to specify and/or modify an email system, supporting servers and a repository server with which system 100 is to be used. System administrator 1611 also enables overall control of system 100. For example, system administrator module is also used to control the installation process and to start, stop or idle system 100. According to one embodiment, system administrator 1611 comprises one or more graphical user interfaces (GUIs).

Scheduling module 1612 comprises a number of interfaces that enable scheduling of voice services. Voice services may be scheduled according to any suitable methodology, such as according to scheduled times or when a predetermined condition is met. For example, the predetermined condition may be a scheduled event (time-based) including, day, date and/or time, or if certain conditions are met. In any event, when a predetermined condition is met for a given service, system 100 automatically initiates a call to the subscribers of that service. According to one embodiment, scheduling module 1612 comprises one or more GUIs.

Exceptions module 1613 comprises one or more interfaces that enable the system administrator to define one or more exceptions, triggers or other conditions. According to one embodiment, exceptions module 1613 comprises one or more GUIs.

Call settings module 1614 comprises one or more interfaces that enable the system administrator to select a set of style properties for a particular user or group of users. Each particular user may have different options for delivery of voice services depending on the hardware over which their voice services are to be delivered and depending on their own preferences. As an example of how the delivery of voice services depends on a user's hardware, the system may deliver voice services differently depending on whether the user's terminal device has voice mail or not. As an example of how the delivery of voice services depends on a user's preferences, a user may chose to have the pitch of the voice, the speed of the voice or the sex of the voice varied depending on their personal preferences. According to one embodiment, call settings module 1614 comprises one or more GUIs.

Address handling module 1615 comprises one or more interface that enable a system administrator to control the address (e.g., the telephone number) where voice services content is to be delivered. The may be set by the system administrator using address handling module 1615. According to one embodiment, address handling module 1615 comprises one or more GUIs.

Voice service wizard module 1616 comprises a collection of interfaces that enable a system administrator to create and/or modify voice services. According to one embodiment, service wizard module 1616 comprises a collection of interfaces that enable a system administrator to define a series of dialogs that contain messages and inputs and determine the call flow between these dialogs based on selections made by the user. The arrangement of the messages and prompts and the flow between them comprises the structure of a voice service. The substance of the messages and prompts is the content of a voice service. The structure and content are defined using service wizard module 1616.

Voice service API 162 (e.g., MicroStrategy Telecaster Server API) provides communication between administrator console 161 and backend server 163. Voice Service API 162 thus enables information entered through administrator console 161 to be accessed by backend server 163 (e.g., MicroStrategy Telecaster Server).

Backend server 163 utilizes the information input through administrator console 161 to initiate and construct voice services for delivery to a user. Backend server 163 comprises report formatter 1631, personalization engine 1632, scheduler 1633 and SQL engine 1634. According to one embodiment, backend server 163 comprises MicroStrategy Broadcast Server. Report formatter 1631, personalization engine 1632, and scheduler 1633 operate together, utilizing the parameters entered through administrator console 161, to initiate and assemble voice services for transmission through call server 18. Specifically, scheduler 1633 monitors the voice service schedules and initiates voice services at the appropriate time. Personalization engine 1632 and report formatter 1631 use information entered through service wizard 1616, exceptions module 1613, call settings module 1614, and address module 1615, and output provided by DSS server 14 to assemble and address personalized reports that can be sent to call server 18 for transmission. According to one embodiment, report formatter 1631 includes an XML based markup language engine to assemble the voice services. In a particular embodiment, report formatter includes a Telecaster Markup Language engine offered by MicroStrategy Inc. to assemble the call content and structure for call server 18.

SQL engine 1634 is used to make queries against a database when generating reports. More specifically, SQL engine 1634 converts requests for information into SQL statements to query a database.

Repository 164 may be a group of relational tables stored in a database. Repository 164 stores objects which are needed by system 100 to function correctly. More than one repository can exist, but preferably the system 100 is connected to only one repository at a time.

According to one embodiment, a call server 18 is used to accomplish transmission of the voice services over standard telephone lines. Call server 18 is shown in more detail in FIG. 12*c*. According to one embodiment, call server 18 comprises software components 181 and hardware components 182. Software components 181 comprise call database 1811, mark-up language parsing engine 1812, call builder 1813, text-to-speech engine 1814, response storage device 1815 and statistic accumulator 1816.

Call database 1811 comprises storage for voice services that have been assembled in VSS 16 and are awaiting transmission by call server 18. These voice services may include those awaiting an initial attempt at transmission and those that were unsuccessfully transmitted (e.g., because of a busy signal) and are awaiting re-transmission. According to one embodiment, call database 1811 comprises any type of relational database having the size sufficient to store an outgoing voice service queue depending on the application. Call database 1811 also comprises storage space for a log of calls that have been completed.

Voice services stored in call database 1811 are preferably stored in a mark-up language. Mark-up language parsing engine 1812 accepts these stored voice services and separates the voice services into parts. That is, the mark-up language version of these voice services comprises call content elements, call structure elements and mark-up language instructions. Mark-up language parsing engine 1812 extracts the content and structure from the mark-up language and passes them to call builder 1813.

Call builder 1813 is the module that initiates and conducts the telephone call to a user. More specifically, call builder dials and establishes a connection with a user and passes user input through to markup language parsing engine 1812. In one embodiment, call builder 1813 comprises "Call Builder" software available from Call Technologies Inc. Call builder 1813 may be used for device detection, line monitoring for user input, call session management, potentially transfer of call to another line, termination of a call, and other functions.

Text-to-speech engine 1814 works in conjunction with mark-up language parsing engine 1812 and call builder 1813 to provide verbal communication with a user. Specifically, after call builder 1813 establishes a connection with a user, text-to-speech engine 1814 dynamically converts the content from mark-up language parsing engine 1812 to speech in real time.

A voice recognition module may be used to provide voice recognition functionality for call server 181. Voice recognition functionality may be used to identify the user at the beginning of a call to help ensure that voice services are not presented to an unauthorized user or to identify if a human or machine answers the call. This module may be a part of call builder 1813. This module may also be used to recognize spoken input (say "one" instead of press "1"), enhanced command execution (user could say "transfer money from my checking to savings"), enhanced filtering (instead of typing stock symbols, a user would say "MSTR"), enhanced prompting, (saying numeral values).

User response module 1815 comprises a module that stores user responses and passes them back to intelligence server 16. Preferably, this is done within an active voice page (AVP). During a telephone call, a user may be prompted to make choices in response to prompts by the system. Depending on the nature of the call, these responses may comprise, for example, instructions to buy or sell stock, to replenish inventory, or to buy or rebook an airline flight. User response module 1815 comprises a database to store these responses along with an identification of the call in which they were given. The identification of the call in which they were given is important to determining what should be done with these responses after the call is terminated. User responses may be passed back to intelligence server 16 after the call is complete. The responses may be processed during or after the call, by the system or by being passed to another application.

Statistics accumulator 1816 comprises a module that accumulates statistics regarding calls placed by call builder 1813. These statistics including, for example, the number of times a particular call has been attempted, the number of times a particular call has resulted in voice mail, the number of times a user responds to a call and other statistics, can be used to modify future call attempts to a particular user or the structure of a voice service provided to a particular user. For example, according to one embodiment, statistics accumulator 1816 accumulates the number of times a call has been unsuccessfully attempted by call builder 1813. This type of information is then used by call server 18 to determine whether or not the call should be attempted again, and whether or not a voice mail should be left.

Call server 18 also comprises certain hardware components 182. Hardware components 182 comprise processor 1821 and computer telephone module 1822. According to one embodiment, processor 1821 comprises a Pentium II processor, available from Intel, Inc. Module 1822 provides voice synthesis functionality that is used in conjunction with Text to Speech engine 1814 to communicate the content of voice services to a user. Module 1822 preferably comprises voice boards available from Dialogic, Inc. Other processors and voice synthesizers meeting system requirements may be used.

The system and method of the present invention may form an integral part of an overall commercial transaction processing system.

According to one embodiment of the present invention, a system and method that enable closed-loop transaction processing are provided. The method begins with the deployment of an IVB by executing a service. As detailed above, this includes generating the content and combining this with personalization information to create an active voice page. Call server 18 places a call to the user. During the call, information is delivered to the user through a voice-enabled terminal device (e.g., a telephone or cellular phone).

During the IVB, a user may request a transaction, service, further information from the database or other request, e.g., based on options presented to the user. These will generically be referred to as transactions. The request may be, but is not necessarily, based on or related to information that was delivered to the user. According to one embodiment, the request comprises a user response to a set of options and/or input of information through a telephone keypad, voice input or other input mechanism. According to another embodiment, the request can be made by a user by speaking the request. Other types of requests are possible.

According to one embodiment, the user responses are written to a response collection, which along with information stored in the active voice page, can be used to cause a selected transaction to be executed. According to one embodiment, the active voice page comprises an XML-based document that includes embedded, generic requests, e.g., a request for a transaction, or a request for additional information (a database query). These embedded requests are linked with, for example option statements or prompts so that when a user enters information, the information is entered into the generic request and thus completes a specific transaction request. For example, in the example if a user exercises an option to buy a particular stock, that stock's ticker symbol is used to complete a generic "stock buy" that was embedded in the active voice page.

According to one embodiment, tokens are used to manage user inputs during the IVB. A token is a temporary variable that can hold different values during an IVB. When a user enters input, it is stored as a token. The token value is used to complete a transaction request as described above. According to one embodiment, the system maintains a running list of tokens, or a response collection, during an IVB.

In order to complete the requested transaction, the user responses (and other information from the active voice page) may need to be converted to a particular format. The format will depend, for example, on the nature and type of transaction requested and the system or application that will execute the transaction. For example, a request to purchase goods through a web-site may require the information to be in HTML/HTTP format. A request for additional information may require and SQL statement. A telephone-based transaction may require another format.

Therefore, the transaction request is formatted. According to one embodiment, the transaction is formatted to be made against a web-based transaction system. According to another embodiment, the transaction request is formatted to be made against a database. According to another embodiment, the transaction is formatted to be made against a telephone-based transaction system. According to another embodiment, the transaction is formatted to be made via e-mail or EDI. Other embodiments are possible.

In one embodiment, the formatted transaction request comprises an embedded transaction request. The system provides interactive voice services using TML, a markup language based on XML. Using TML active voice pages are constructed that contain the structure and content for a interactive voice broadcast including, inter alia, presenting the user with options and prompting the user for information. Moreover in connection with OPTION and PROMPT elements, active voice pages also can include embedded statements such as transaction requests. Therefore, the formatting for the transaction request can be accomplished ahead of time based on the particular types of transactions the user may select.

For example, in connection with an exemplary stock purchase, an active voice page can include an embedded transaction request to sell stock in the format necessary for a particular preferred brokerage. The embedded statement would include predefined variables for the name of the stock, the number of shares, the type of order (market or limit, etc.), and other variables. When the user chooses to exercise the option to buy or sell stock, the predefined variables are replaced with information entered by the user in response to OPTION or PROMPT elements. Thus, a properly formatted transaction request is completed.

TML parsing engine in call server 18 includes the functionality necessary to generate the properly formatted transaction request as described above. For example, in connection with the embodiment described above, the TML parsing engine shown in FIG. 3*c* reads the active voice pages. When the TML parsing engine reads an OPTION element that includes and embedded transaction request, it stores the transaction request, and defines the necessary variables and variable locations. When the user exercises that OPTION, the user's input is received by the TML parsing engine and placed at the memory locations to complete the transaction request This technique could be used, for example, to generate a formatted transaction request for web-site.

According to another embodiment, where the transaction request is made via a natural language, voice request, a formatted transaction request can be generated in a number of ways. According to one embodiment, speech recognition technology is used to translate the user's request into text and parse out the response information. The text is then used to complete an embedded transaction request as described above. According to another embodiment, speech recognition software is used to translate the request to text. The text is then converted to a formatted request based on a set of known preferences.

A connection is established with the transaction processing system. This can be accomplished during, or after the IVB. According to one embodiment, the transaction processing system comprises a remotely located telephone-based transaction site. For example, call server 18, through the TML parsing engine 1812, establishes a connection with a telephone-based transaction processing site.

According to another embodiment, the transaction processing system comprises a remotely based web-site. According to this embodiment, the formatted request includes a URL to locate the web-site and the system accesses the site through a web connection using the formatted request. Alternatively, the formatted request includes an e-mail address and the system uses any known email program to generate an e-mail request for the transaction.

After the connection is established, the transaction is processed by the transaction processing site and the user is notified of the status of the transaction. If the transaction is completed in real-time, the user may be immediately notified. If the transaction is executed after the IVB, the user may be called again by the system, sent an e-mail, or otherwise notified when the transaction has been completed.

According to one particular embodiment, the system comprises an interactive voice broadcasting system and the transaction is accomplished in real-time. In this embodiment, confirmation of the transaction is returned to TML parsing engine 1812 shown in FIG. 12*a–c* and translated to speech in text-to-speech engine 1814 and presented to the user during the IVB. More specifically, and similar to the process described with respect to embedded formatted transaction requests, TML also enables embedding of a response statement. Thus, when the transaction is processed and confirmation of the transaction is returned to the system, an embedded confirmation statement is conveyed to the user through TML parsing engine 1812 after being converted to speech in text-to-speech engine 1814.

The central security network of the present invention may operate through several distribution channels. For example, devices and/or services may be sold directly to end users over the Internet through an associated web site. The web site of the present invention may also be used to sell the alarm network service to individuals or entities who may already own alarm systems and are interested in the personalized monitoring feature of the present invention.

In another example, a distribution channel may involve an affiliate network which may include alarm dealers and installers. Because do-it-yourself wireless equipment may not meet everyone's needs, the present invention may have mini-partnerships with affiliates. Namely, the affiliate may retain the revenue for selling and installing the devices, and then refer the client to the alarm network of the present invention for monitoring and/or other services. As an incentive, an operator of a system according to the present invention may offer a referral program to reward affiliates for each client who subscribe to a service of the network.

In another example, the central security network may syndicate alarm services to current central monitoring stations, and thereby become an ingredient brand. For example, a major security entity may use services of the central security network as part of its service offering to the end consumer.

An embodiment of the present invention provides the ability to report an index of activity within an identified area. The identified area may include a house, one or more rooms within a house, an office, store location, warehouse, multiple locations, any identified area, etc. The area may also be defined by one or more sensor or other monitor devices. The index of activity may be based on data gathered from one or more sensor devices, such as contacts, motion sensors and/or other devices, at the identified area. This feature may involve some knowledge as to the nature and distribution of sensors within a location. The index of activity may be reported to a subscriber or other recipient. The information may be conveyed via one or more preferred modes of communication (e.g., wireless communication, broadband, landline, etc.). In addition, the index of activity may be displayed on an online interface, as a graphical representation or other display. Through this feature, a subscriber or other entity with access may view the data. The display may further enable the viewer to manipulate the data.

The term "wireless" may include long range wireless radio, local area wireless network such as 802.11 based protocols, wireless wide area network such as WiMax and/or other similar applications.

Activity index may provide information related to sensor activity. For example, a store may monitor how many times a front door of a store is opened, indicating an amount of traffic within a store, within a time frame (e.g., one day, one week, weekends, etc.). Other devices, such as motion detectors, may monitor an amount of movement, e.g., foot traffic, within a store or even a certain location (e.g., shoes section, etc.), in a store. This information may be used to monitor busy seasons (e.g., Christmas, Mother's Day, etc.), different locations (e.g., California store, New York store, DC store, etc.) and/or other factors. Also, the effectiveness of sales or other promotions and their ability to contribute to additional traffic, business, etc., may be monitored.

According to another example, an executive at a company may want to get a sense for when employees generally arrive at work without requesting time sheets, or implementing more intrusive technology. By reviewing an activity index, which may report a summary view of all or selected sensor activity, this executive may see when most employees arrive at work. According to another example, a parent who works or travels wants to know when their child might be hosting an event at their home. Typically, if the child is at home alone, the activity index will report a fairly modest value. However, when there are lots of people entering, exiting, and moving throughout the home, the activity index value will be much higher. The parent may establish an alert to only be notified when activity index levels exceed the typical value. According to another example, a person may own a second home and wants to know if the home is being rented or is sitting idle. In this way, he/she can assure that he is being properly compensated by the property management firm for all weeks in which the property is rented. The owner of the second home, however, does not want to invade the privacy of his rental clients by installing video cameras or other detection devices. During a week in which the property is not rented, the activity index values will be low, as the property is only occasionally entered by maids, service technicians, and potentially by personnel who deliver fresh linens or food and snacks to the property. When the property is rented, activity index values will be much higher. The property owner may quickly validate that he/she is being paid for all weeks in which the property is rented by reviewing activity index values for each calendar week.

The compiled data may be displayed in various formats, where the level of detail of the activity may be specified. For example, a graphical indicator may display levels of activity, such as low, normal and high. The thresholds may be specified by the user or determined by an embodiment of the system. For example, the system may average the amount of traffic (which may be indicated by an amount of times the door is opened according to one exemplary application) over a time frame and use that average as a "normal" level. A certain amount of deviation may be determined for indicating a high level and a low level, as well as additional levels of activity. In addition, graphical display, such as color codes, bar graphs, etc. may be implemented. For example, red may indicate high level, green may indicate average and yellow may indicate low. Other graphics and display options may be implemented. Additional levels of detail may also be provided. For example, a marker for indicating a sales event may be used to explain a particular high level of activity. Other factors may also be displayed and considered as desired by the subscriber.

Figure 13:
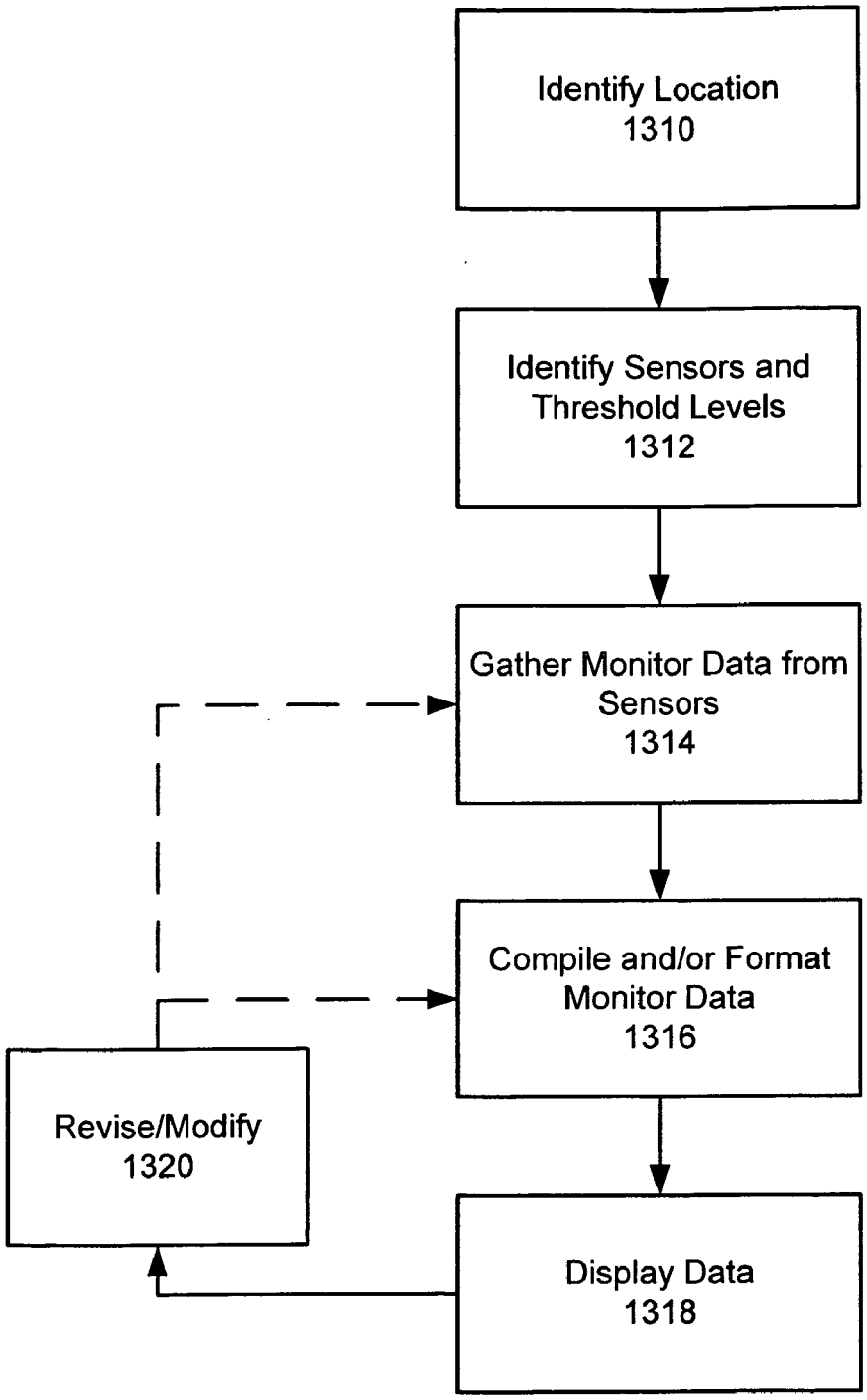
FIG. 13 is an exemplary flowchart illustrating a method for activity index reporting, according to an embodiment of the present invention.

FIG. 13 is an exemplary flowchart illustrating a method for activity index reporting, according to an embodiment of the present invention. At step 1310, a location may be identified. The location may include a combination of sensors and/or other monitor device. The location may include a subset within a location (e.g., one or more rooms within a home, etc.). The location may include one or more locations (e.g., stores located at different areas, etc.). At step 1312, one or more sensors associated with the location may be identified. The sensors may include door contacts which may be used to indicate an amount of foot traffic within a store location. The sensors may also include motion detectors, video sources, vibration sensors, pressure mat sensors, turn style counters and/or other devices which may provide an indication of activity at the location. The sensors may also be used to monitor normal activity as well as no or low levels of activity. At step 1314, data from the sensors may be gathered. The data may include monitor data for gathering information concerning movement and/or other indicator of activity.

The gathered data may then be compiled and/or formatted, at step 1316. For example, a level of detail, granularity, and/or other defined specifics may be identified and applied to the gathered data. In addition, threshold events and/or levels may also be identified and applied. For example, data may be averaged over a time period to determine an average level of activity. A variance amount may be identified which may be used to determine a high level, a low level and/or other levels of activity. At step 1318, the compiled and/or formatted data may be displayed to the subscriber and/or other authorized entities. The data may be displayed as a graphical display to highlight the level of activity. For example, the activity index may be displayed as a color coded display where red may indicate a high level of activity, green may indicate an average level of activity and yellow may indicate a low level of activity. Other graphical displays, such as bar graphs, line graphs, pie charts, and/or other displays may be used to display the information. According to another example, the compiled and/or formatted data may be forwarded to one or more recipients via one or more desired mode of communication. At step 1320, the information may be revised and/or modified as desired by the subscriber or other authorized entity. In addition, the information may be automatically updated. For example, the data collected may be used to continuously update an average level of activity and/or other indicia of activity. For example, as a store location gains popularity and more loyal customers, an average level of activity may be at a higher level.

Additional exemplary outputs may include markers for showing various types of activity. For example, activity index may indicate that a store is very busy today (high activity index), nobody is home (low/zero activity index), normal activity levels at store/home (average activity index) and/or other indicators of activity.

According to another embodiment of the present invention, a subscriber may access anomaly information. For example, a subscriber may be alerted if activity patterns at a location differ from previous activity patterns. A subscriber may define an activity baseline through an interface or other mode of communication. The activity baseline may indicate a level of "normal" activity. The normal activity may involve averaging historical data where previous activity patterns may be accessed from history data (e.g., an average of the last 14 days of activity, etc.). In another example, the normal activity may be an expected level of activity (e.g., expect no movement in the backyard at night time). Using the activity baseline, an embodiment of the present invention may identify whether or how much the activity varies from the activity baseline for an alert (or other message) to be delivered. A variance amount may be identified to detect when an alert message is transmitted. Recipients and their corresponding preferred communication methods may be identified.

History data may include sensor data which indicates movement (e.g., door opening, window opening, etc.) and/or any activity. History data may also include video data (e.g., images of back door, etc.). History data may also consider external sources of data, such as data from neighbors, recent local burglaries, police reports, and/or other information. For example, a store owner may monitor anomalous activity during closed hours. The store owner may also monitor whether a door is opened and closed around closing time to ensure that proper shut down procedures have taken place. In another example, any lack of movement for a predetermined period of time may also be monitored at a home (or a specific room) of an elderly person. For example, if there is no movement in the morning hours in the bedroom of an elderly relative, an alert may be triggered. The baseline of activity may be defined as some movement during the hours of 6 am and 9 am, assuming that the elderly relative usually wakes up during that time period. In another example, the amount of movement may be monitored and identified across time frames. Therefore, rather than having to keep track of morning habits, the system of an embodiment of the present invention may monitor and track movement so that it will automatically determine that movement occurs within the hours of 6 am and 8 am every morning.

According to another example, an office building is generally initially accessed by an employee or other person entering through the front or back door. That is, after the office building has remained idle (due to no people being present) for a period of time, the first event reported is always that the front or read door has been opened. Generally, an office building is not initially accessed by opening the ground floor window. Thus, even if the security system were disarmed, the system may generate a user alert or an alarm condition if the ground floor window were opened when there was no activity inside the office building.

According to another embodiment, the system of the present invention may self-configure and establish an activity baseline by observing regular activity for a period of time. Through this exemplary embodiment, security and/or activity monitoring may become a passive activity. For example, through an embodiment of the present invention, a building (or other location, such as home, store, rooms, etc.) may automatically determine an anomalous condition based on previous normal activity. The previous normal activity may be automatically determined by historical data or defined by a subscriber or other entity. In this example, a process using event analysis algorithms may be applied to determine an anomalous event or condition and how severe the anomaly might be. At a simple level, sensors at a residential location may continuously monitor state data. Therefore, rather than activating an alarm state, the sensors may monitor and detect an anomaly. In this example, the sensors may constantly monitor (in an "on" state) and report an alarm or message where there is a preponderance of events worthy of an alarm. Current systems require the consumer to actively manage their system by arming in order for the system to detect an unexpected or unwanted intrusion.

Figure 14:
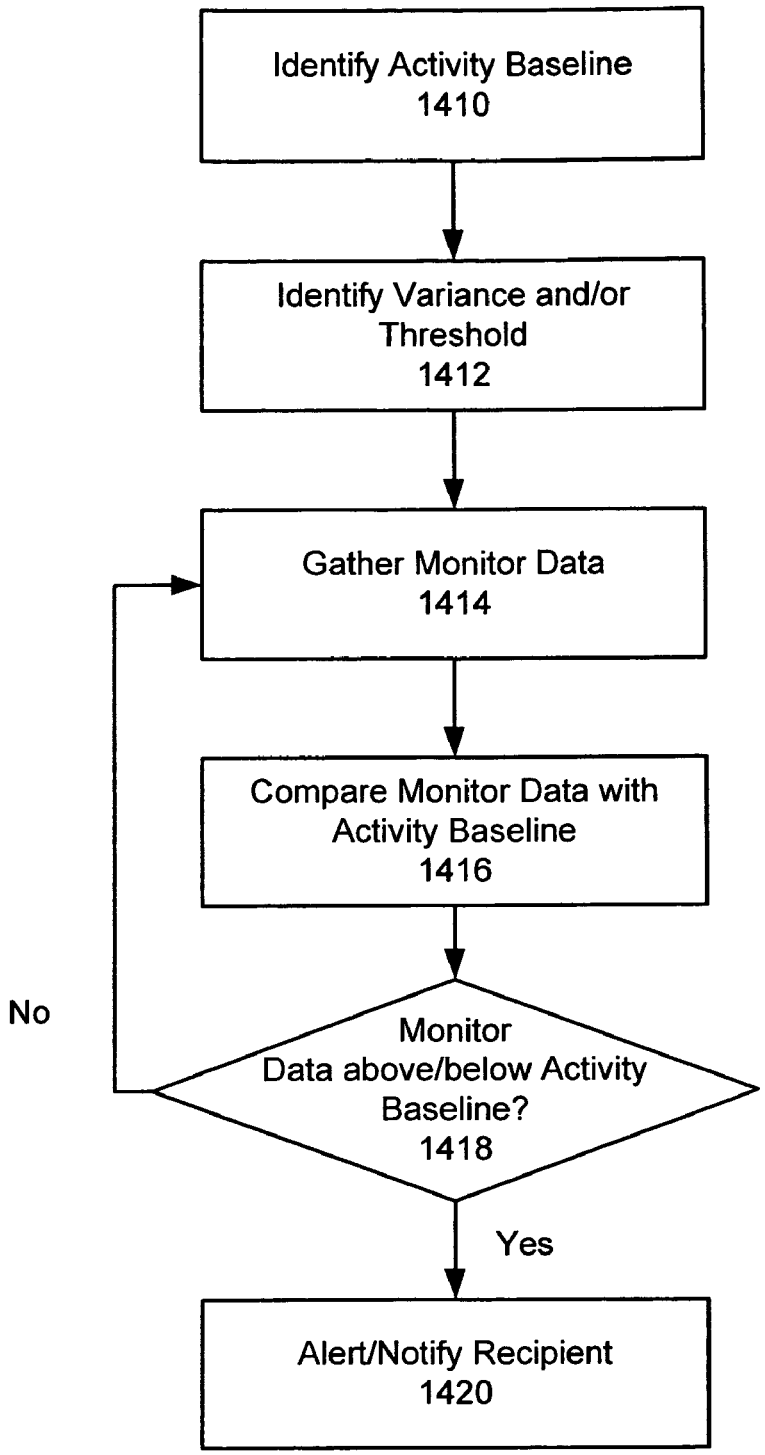
FIG. 14 is an exemplary flowchart illustrating a method for detecting anomalous activity, according to an embodiment of the present invention.

FIG. 14 is an exemplary flowchart illustrating a method for detecting anomalous activity, according to an embodiment of the present invention. At step 1410, an activity baseline may be identified. The activity baseline may indicate an average or normal level of activity. The activity baseline may be defined by a subscriber or other authorized entity. According to another example, the activity baseline may be automatically determined. For example, an average of historical data may be calculated. Other methods for determining a baseline of activity may be implemented. At step 1412, a variance and/or threshold may be identified. The variance and/or threshold may be used to identify an anomalous event. Other calculations, measurements, events and/or other defined triggers may be applied to determine anomalous activity. For example, an activity baseline may be identified and if monitored data differs from the activity baseline by a variance or threshold amount, an anomalous event may be detected. For example, an amount of movement or activity may be determined as average for the room or home of an elderly person. However, if a lack of movement is detected for an overextended period of time, an anomaly may be detected. This information may be forwarded to one or more identified recipients via one or more preferred methods of notification. Another example may include a door contact at closing time, which indicates that the last employee has left the store at closing time. In this example, the anomalous event may be an inactive door contact at closing time. The monitored activity may be activity, a lack of activity and/or an expected level of activity.

At step 1414, sensor data may be gathered from one or more sensor devices at an identified location for anomaly detection. For example, sensor devices may include door contacts, window contacts, motion sensors and/or other device for monitoring activity. At step 1416, the gathered sensor data may be compared to the activity baseline. Other methods for determining anomalous activity may also be applied. At step 1418, it may be determined whether the gathered sensor data is above and/or below the activity baseline by a threshold amount. If so, an alert or other notification may be conveyed to one or more identified recipients via a preferred method of notification. If not, sensor data may be continuously gathered.

An embodiment of the present invention is directed to a single integrated interface for displaying security data for a plurality of locations. Devices (e.g., sensors, monitors, etc.) may be controlled across locations through this single interface. Currently, security systems are controlled by their users by interacting with a type of alphanumeric or other touchpad interface locally at the secured site. An embodiment of the present invention enables remote administration of a security system using a web interface where remote control and configuration of multiple security systems via a single integrated web based user interface may be implemented. This feature of an embodiment of the present invention provides a single login and a single interface for viewing subsets of information for a plurality of locations at once. For example, a subscriber may monitor activity levels across multiple locations through the single interface. A subscriber may also manipulate and control one or more security control panels across multiple locations.

Another aspect of this embodiment of the present invention involves the ability to assign different security privileges to different enterprise users for control of a security system, which may include one or more different locations. This action may be performed through the single interface. Currently, a panel has a master user code and user codes. Oftentimes, a business owner may want the ability to set his own code, and the code of his day shift and night shift managers. In this example, he may want each of those managers to be able to set the codes for each of their employees, but not for the other manager, the other manager's employees, or for the owner. A privilege hierarchy may apply to this exemplary application. According to an embodiment of the present invention, a central server of an embodiment of the present invention may control one or more user codes for an identified location. The control panel located at the location may then be updated to support the multiple levels of user codes as desired.

According to an embodiment of the present invention, a single interface may provide security data as well as control for a complex enterprise security system with hundreds or thousands of remotely deployed units. From this single command console interface, an operator may issue a global configuration command which will almost instantly, via a wireless conduit, reprogram select or all control panels. For example, a central security office may decide that all panels in all remote facilities should now automatically arm themselves every day at 8:15 pm instead of 8:00 pm. An embodiment of the present invention allows these functions from a single interface, thereby avoiding costly trips to each location. In addition, the central security office may decide that a former senior operations executive, who previously had access to all facilities, should no longer be able to disarm the security systems at any property. By using an enterprise console web interface, this change may be wirelessly propagated across select or all security control panels in the enterprise.

An embodiment of the present invention enables a subscriber to arm a system (or identified group of sensors) automatically. An exemplary application may involve a situation where a system has been left disarmed by mistake. A typical application may involve a store where an owner/manager wants to ensure that a system is armed at night even if the last employee to leave the building forgets to arm the system. An embodiment of the present invention allows a system manager (or other entity) to configure arming supervision capabilities via an interface. In addition, the system manager may instruct the system to automatically arm under certain circumstances, even if the security control panel is not connected to the Central Station or other monitoring service via any wired connection. Further, the system manager may generate alerts that system was not armed or that system was auto-armed and send those alerts via any format (e.g., email, text message, phone call, etc.) desired by the system manager.

Subscribers may identify parameters for automatically arming a system. For example, a subscriber may identify a time period for arming a system, an activity, inactivity, an event, lack of an event and/or other trigger. For example, the time period may define how long a system will wait after the last activity was reported by one or more sensors before arming. A subscriber may designate an auto arming of a security system at a store (or other location), 30 minutes after closing time. In another example, a trigger time, such as 11:30 pm may be identified. The subscriber may designate different triggers for different days. Closing time may be later during the weekends, thereby requiring a delayed auto arming of the security system. In addition, holiday schedules, summer schedules and other variations in store hours may also affect the auto arming feature. Subscribers may also identify triggering activities. For example, the subscriber may identify that if no activity is detected for 15 minutes, during a time period (e.g., the midnight hours, etc.), the auto arming feature may be invoked.

In addition, a subscriber may specify an alert based on an arming condition. If the system is not armed at a specified level by a specified time, the subscriber may be alerted by a preferred method of communication. For example, if the system is not armed by 11 pm on Tuesday, then the customer receives a phone call at a preferred number (e.g., cell phone, home number, etc.). If a response is not received, a second attempt may be made after a predetermined waiting time (e.g., 15 minutes, etc.). If no answer is received, the system may invoke an automatic arming mode. Further, the automatic arming may be at a default level of security. An embodiment of the present invention allows a user to configure supervisory alerts via an interface, allows the user to receive the alerts via email, text message or phone medium where the messages may be received from the panel via a wireless network so that a phone line connection to the panel is not required to provide these capabilities.

Various conditions may also be identified. Rather than automatically arming the security system, the subscriber may be notified that the security system is not armed and allow the subscriber to decide whether to arm the system remotely. For example, the system may detect that the security system is not armed by 11:30 pm and notify the subscriber. The subscriber may elect to remotely secure the security system may selecting a button on the subscriber's phone, email, online interface or other interface.

Figure 15:
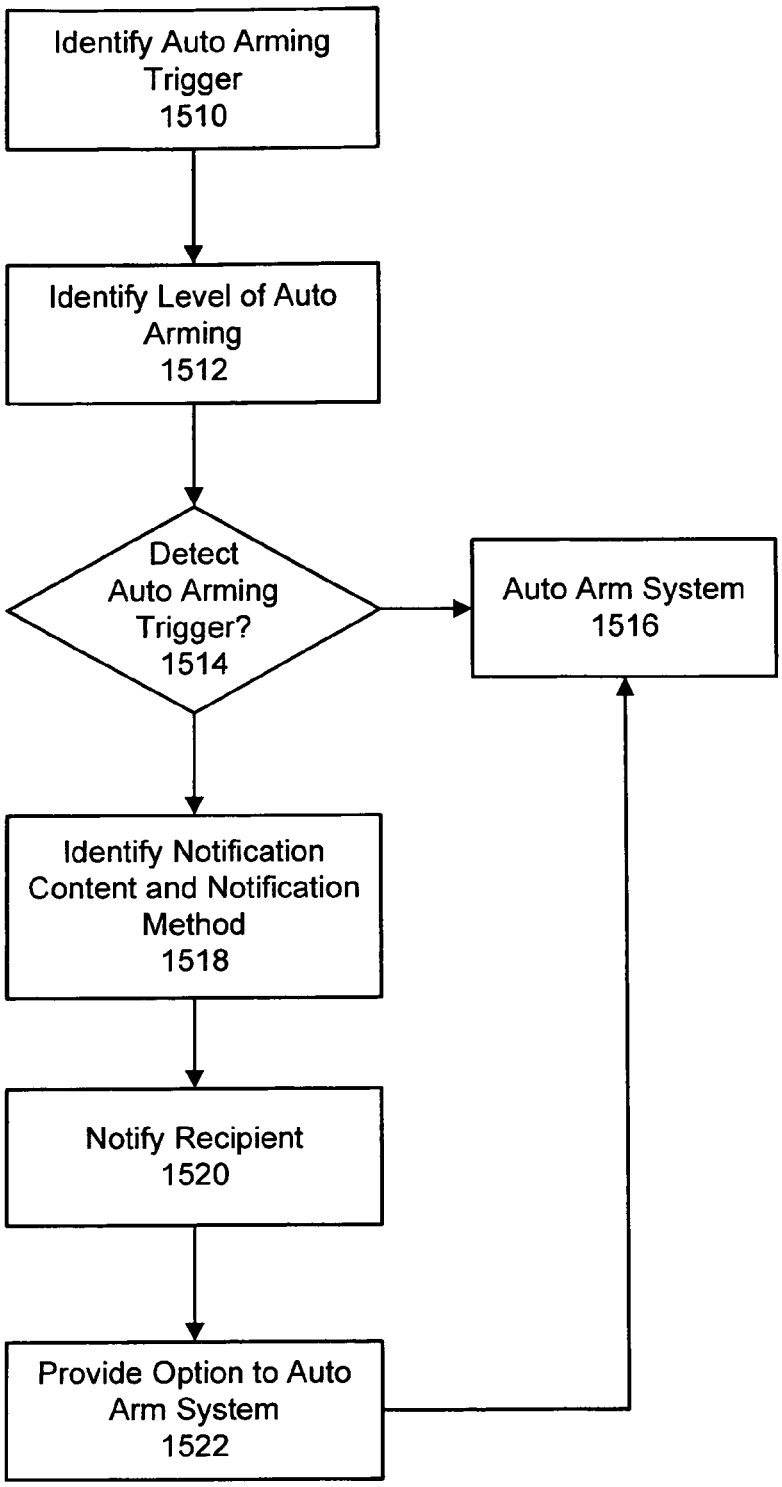
FIG. 15 is an exemplary flowchart illustrating a method for automatic arming of a security device or system, according to an embodiment of the present invention.

FIG. 15 is an exemplary flowchart illustrating a method for automatic arming of a security device or system, according to an embodiment of the present invention. At step 1510, an auto arming trigger may be identified. The auto arming trigger may be an event, circumstance or other trigger for initiating an automatic arming of a sensor, plurality of sensors, system or multiple systems. The automatic arming may also apply to a plurality of sensor devices (or other security devices) across multiple locations or systems, as well as any device or location. For example, the trigger may include a time period, trigger time or other time dependent event. In this example, the trigger may be 15 minutes after closing time, e.g., 11 p.m. Closing time may also vary day to day. A trigger may include an event, such as anomalous activity, discussed above in connection with FIG. 14. A trigger may also include no activity (e.g., motion sensor detecting no activity, etc.). A preferred level of auto arming may be identified, at step 1512. The level of auto arming may be applied to an identified location, a sensor or group sensors or other identified area. For example, there may be a default level of security, low level of security, high level of security, etc. In addition, one or more sensors may be individually activated.

At step 1514, it may be determined if a system (or other identified group of sensors) should be automatically armed. If so, the system (or other identified group of sensors) may be automatically armed to a desired level, at step 1516. Otherwise, a notification may be identified as well as a corresponding preferred method of notification, at step 1518. For example, a warning message may be conveyed via a preferred method of notification, at step 1520. The warning message may identify the anomalous activity—the level of detail to be received may be identified by the subscriber (or other recipient, etc) or may be based on the type of anomalous activity detected. The subscriber may also specify that if a response is not received from an intended recipient, automatic arming may be applied. In addition, the warning message may notify a recipient that a system will be automatically armed within a time period, e.g., 3 minutes left until automatic arming of system, etc. The notification content may be forwarded to one or more recipients via a preferred method or methods of notification. For example, a store owner may be notified via email that a trigger event has occurred (e.g., time period lapse, etc.). At step 1522, a subscriber or other authorized entity may be given the option to automatically arm a system and/or one or more sensors. This action may occur via a website, wireless communication (e.g., mobile device, phone, PDA, etc.) or other method of communication.

According to another embodiment of the present invention, Global System for Mobile Communications (GSM) or other wireless devices may report normal activity (e.g., doors opening, motion sensors activating, etc.) while the system is not armed. A GSM radio or similar device may be integrated into a control panel which transmits signals to a central monitoring station. Normal activity monitoring may involve any type of connection to a local control panel, which may include wired broadband, wireless broadband, two-way paging, WiMax, GSM/GPRS, or other mode of communication.

Another embodiment of the present invention is directed to normal activity event handling and normal activity event notifications. For example, intelligent normal activity notifications may involve defining a normal activity event as something as routine as a kitchen door opening. Sometimes the event may be of immense interest to a user, and at other times, it may be of no interest. Intelligent normal activity notifications allow the user some control over who is notified of the event, and when they are notified. An embodiment of the present invention provides an interface in which the user may specify properties to govern normal activity notifications. For example, the use may specify to all subscribers of the normal activity event, one subscriber, several subscribers, or none at all. In this manner, each specific type of normal activity event may be directed at a specific intended audience. Therefore, a user may subscribe themselves or others to notifications for a specific normal activity event or alarm events, with notifications being driven by normal activity events.

Another embodiment of the present invention is directed to intelligent routing of normal activity data, For example, a sensor in a home or business may generate an unmanageable number of events. For example, a motion sensor, sitting in an elementary school may generate an event every time a person passes in its vicinity and throughout the day, may therefore generate a large number of events. This event traffic would otherwise be extremely taxing on the wireless network connection to the school, and would create data clutter that is of no use to the subscriber. Further, this sensor might inadvertently result in the user receiving thousands of unexpected emails, text messages, or phone calls in a day. An embodiment of the present invention may intelligently process the sensor data and apply logic to separate out meaningful data from meaningless data. In the example of the school, an embodiment of the present invention may automatically only report the first motion sensor event, and the last motion sensor event, filtering out all other data, but noting for the user that the motion detector was "active" during the period between the first and last event. In addition, an embodiment of the present invention may also support intelligent rule based subscriptions, scheduled normal activity notifications and/or other similar functions.

An embodiment of the present invention may display or send reports on normal activity, on a periodic, event and/or request driven basis. This may occur on a daily or weekly basis or based on certain trigger events. The reports may include normal activity and alarm events made up of events gathered through a local RF sensor network and the wireless communicator. An embodiment of the present invention enables users to obtain reports on normal activity events in addition to alarm and arming events; specify via an interface the contents of the report, delivery frequency and/or other features; obtain reports which may be generated from data collected via a wireless connection to one or a group of control panels and/or other devices; and allow end-user customers to directly subscribe to these reports and receive them via email in any format desired.

An embodiment of the present invention provides the ability to alert customers when no activity has been detected at the location for a specified period of time. Subscribers may specify day of the week, period of day, and a subset of sensors for participation in this determination. An embodiment of the present invention allows a user to use an intuitive web interface to establish which sensors should be monitored for no activity in the no activity trigger. In addition, a user may establish one or many no-activity triggers. Select or all data may be analyzed centrally in Network Operations Center. Even if the panel does not natively offer no-activity monitoring, an embodiment of the present invention may determine that there is no activity by centrally monitoring sensor events. Sensor event data may be collected wirelessly, via long range two-way wireless network. Given that activity levels may be monitored centrally using a central server, such as a network operations center (NOC), the presence of activity may be monitored in a collection of facilities, not just one facility. In addition, users may establish complex "no-activity rules" which are more detailed in their definition than traditional no-activity monitoring.

An embodiment of the present invention is directed to moving functionality built into or associated with security panels into one or more centralized security servers (e.g., centralized network operation centers (NOC)). Through an embodiment of the present invention, the abilities to manage the arming state (e.g., active alarm, armed, disarmed, armed stay, armed away, etc.) of the system, the user codes of the system, the security system logic including the definition of events or circumstances which constitute an alarm, the security system properties (e.g., arming delay, disarm window, sensor properties, sensor zones, sensor groups, etc.), the alarm reporting by the Control Panel, and other control panel capabilities, may be handled by software executing on one or more centralized security application servers. This security system architecture has many advantages to the consumer, including lower equipment costs, greater system capability, greater system reliability and maintenance, and more prompt updates of new capabilities and features.

Most current security systems require a clunky metal box that includes components for installation in each secured property. Most, if not all, of the control panel logic is programmed into the panel and resides at the panel. A significant update to the Control Panel capabilities or logic requires that the Panel be replaced with new equipment and therefore requires a service visit to the home or business where the Control Panel is deployed. An embodiment of the present invention provides a security panel that does not contain any sophisticated application logic or interfaces and which essentially functions as an antenna or other similar device for collecting and sending sensor state data to a central system. The security application exists as software, servicing multiple homes and businesses simultaneously, in a NOC. As such, the control panel capabilities and application logic may be easily updated and/or otherwise modified by updating the software operating at the NOC.

According to another embodiment, the sensors themselves may simply message their state (or other information) to a central system and the "security system" is essentially just a defined collection of sensors who send their state and unique identification (and/or other information) to the central system via a network (e.g., wireless, broadband, etc.). The same sensor may be defined to be included in several different security systems at the same time. For example, sensors 4, 5, 6 and 7 may together constitute the security system for a stock-room, while sensors 4, 6, 8, 9, 10, 11, 12 and 14 may represent the security system for a building. In the case of both systems, there is no traditional Security Control Panel involved as the sensors simply message their state and unique identity directly, or via a data hub, to the central security software operating at a central NOC and servicing multiple systems simultaneously.

According to another embodiment, video data may be correlated with security sensor events transmitted from a panel. An embodiment of the present invention may correlate specific video sequences with specific security panel or security sensor events in a relational database that may be analyzed for interesting and/or unusual activity. In this example, sensor data may be transmitted from one or more sensor devices at a subscriber location to a central server through a network connection (e.g., wireless, broadband, etc.). A subscriber may register for certain video clip notifications which are triggered when an event of interest occurs. For example, a subscriber may request notification when a front door opens, and request that the notification include a video clip of the front door at the time it was opened. The subscriber may also request a video link or other image data when an unrecognized person enters. According to another example, if an internal motion is triggered but no door has opened and video analysis suggests that a human is inside, the subscriber may request an alert notification with a single frame clip.

Figure 16:
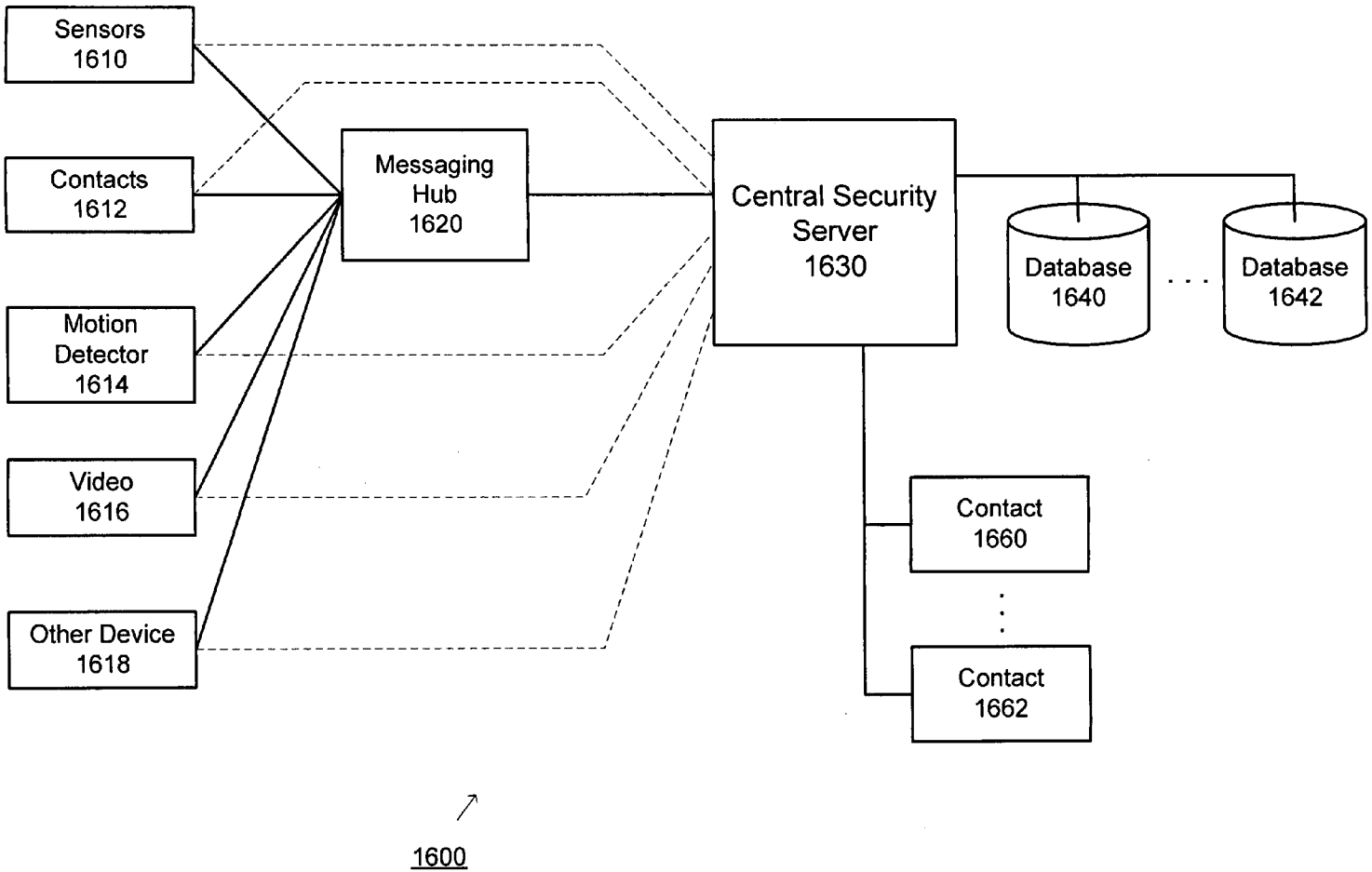
FIG. 16 is an exemplary diagram illustrating a system for a hosted security operating system, according to an embodiment of the present invention.

FIG. 16 is an exemplary diagram illustrating a system for a hosted security operating system, according to an embodiment of the present invention. System 1600 is a variation of system 100 discussed in detail above. System 1600 may include a plurality of monitor devices of varying type that transmit data to a messaging hub 1620, which may be integrated with or separate from a control panel or other similar device. The monitor devices may include sensor 1610, contact 1612, motion detectors 1614, video recorder 1616 and/or other device 1618. The monitor devices may be located at the same location, affiliated location, remote location, etc. The monitor devices may span across multiple subscribers and/or across multiple locations.

The messaging hub 1620 may be local or remote from the sensors. The messaging hub 1620 in this embodiment functions essentially as an antenna for receiving data from the monitor devices and forwarding the data to a Central Security Server 1630. Messaging hub 1620 may gather monitor data and forward the monitor data to Central Security Server 1630. In addition, messaging hub 1620 may buffer the monitor data to facilitate data transmission. Messaging hub 1620 may transmit the monitor data via various modes of communication, including by way of example wireless communication, broadband, WiMax, etc. Other device 1618 may also include a user interface box, connected over a long range network or other network to central security server 1630 and/or messaging hub 1620.

According to another embodiment, the monitor devices may transmit data to Central Security Server 1630, thereby bypassing messaging hub 1620. Monitor devices (e.g., sensors 1610, contacts 1612, motion detector 1614, video 1616 and/or other device 1618, etc.) may communication individually to Central Security Server 1630 via various modes of communication, including wireless communication, broadband (wireless and/or wired) and/or other methods. Central Security Server 1630 may receive monitor data from the various remote devices for compiling, processing and/or responding. Other actions may also be taken in response to the data.

Databases 1640, 1642 may store relevant information for processing the monitor data as desired by a subscriber. Exemplary database information may include user information, alarm events, reports and/or other information. In addition, subscribers and/or other designated recipients, as shown by contact 1660 and 1662, may be alerted or notified of certain events, triggers, reports and/or other desired information, via various preferred modes, including by way of example, POTS, cable modem, DSL, wireless, broadband, etc.

Another embodiment of the present enables remote programming, configuration, and trouble-shooting of the Security Control panel via a wireless network connection, collectively "wireless toolkit enablement." As Security Control Panels are increasingly networked to a Central Monitoring Station via a wireless network (instead of a phone line), it is critical that a servicing security dealer (or other entity) still be able to remotely configure and trouble-shoot the Control Panel even though they are not able to "dial into" the panel and use the traditional "panel toolkit" that they have used for such purpose. An embodiment of the present invention is directed to providing remote programming capability through a two-way wireless connection to the Control Panel. Examples of toolkit capabilities that are enabled wireless by may include various functions, such as Get Panel Status; Send request for panel error codes; Create a new user; Delete a user from the panel; Change the behavior of a sensor (e.g., Arm Stay to Arm Away to Never Arm); Change arming behavior (e.g., delays prior to arming or after perimeter is breached); Disable a sensor; Assign sensor to a different partition; Enable/disable entry chimes; Enable/disable trouble beeps; Lock-down panel; terminate monitoring service as well as other features and functions.

An embodiment of the present invention may provide sensor based notifications. In this embodiment, a subscriber or other recipient may be alerted by a preferred mode of communication when one or more specific sensors identify an alert worthy event. For example, a homeowner may want to be alerted by wireless phone (or other mobile device) if the front door contact is triggered. A preferred mode of notification may be specified and correlated to a specific sensor. Therefore, when the specific sensor identifies an alarm event or other activity, a recipient may be alerted by the preferred mode of notification. In addition, the recipient may also receive reports of normal activity from the specific sensor. For example, person A may be alerted via email if the back door sensor opens, while person B may be alerted via mobile phone if the garage door opens. Also, the type of event may also determine which recipient receives a notification. For example, person C may be alerted if the door opens and person D may be alerted if the door sensor's battery is getting low. Other variations may be realized.

An embodiment of the present invention may provide schedule based notifications. In this embodiment, a subscriber or other recipient may identify a schedule at which alerts and/or other notifications may be transmitted. Many subscribers have a work schedule from Monday through Friday and a different weekend schedule for Saturday and Sunday. In addition, many stores have different hours of operation on the weekend (e.g., longer hours). Other subscribers may have weekly events (e.g., evening classes, book club meetings, etc.) as well as seasonal events (children's sporting events, etc.). Therefore, depending on when an alarm worthy event (or other trigger) occurs, the subscriber may prefer different messages, methods of notification and/or other criteria. An embodiment of the present invention provides an ability to set the day of the week and the period of the day when alerts (and/or other notifications) may be transmitted via a preferred mode of communication (e.g., wireless, mobile phone, voice message, etc.). For example, a subscriber may elect to receive an email if the front door opens during the day on weekdays, but not during weekends or during the night.

According to an embodiment of the present invention, a subscriber may select or identify which sensor will cause a notification (e.g., alarm or normal activity) through an online interface (e.g., website, etc.) by selecting each sensor listed on the page for the given location.

According to an embodiment of the present invention, a subscriber may define complex logic to dictate whether or not a normal activity notification is issued. For example, the subscriber may specify that a notification only be issued when sensor A is opened, and sensors B, C, and D have not opened in the last hour, and motion A is active, but Motion B is not active, and no notifications related to sensor A have been issued in the last four hours, and today is a weekend day and the system is in an armed stay state.

Other embodiments, uses and advantages of the present invention will be apparent to those skilled in the art from consideration of the specification and practice of the invention disclosed herein. The specification and examples should be considered exemplary only. The intended scope of the invention is only limited by the claims appended hereto.

What is claimed is:

1. A computer implemented method for determining an index of activity within a security system, the computer implemented method comprising the steps of:

storing user profile information wherein the user profile information comprises user defined preferences;

gathering monitor data from one or more remote sensor located at a location;

compiling the monitor data based on at least one user defined preference, wherein the compiled monitor data indicates an index of activity; and displaying the compiled monitor data.

2. The method of claim 1, wherein the compiled monitor data is displayed on an online graphical user interface.

3. The method of claim 1, wherein the index of activity is a numeric value that is displayed.

4. The method of claim 1, wherein the step of displaying the compiled monitor data is displayed remotely to a user on a remote device.

5. The method of claim 1, wherein the index of activity indicates an amount of traffic within the location.

6. The method of claim 1, wherein the index of activity indicates an amount of movement within the location.

7. The method of claim 1, wherein the step of compiling further comprising the steps of:

identifying a plurality of levels of activity; and determining which level of activity the monitor data corresponds to, wherein the online graphical user interface displays the corresponding level of activity.

8. The method of claim 7, wherein the plurality of levels of activity are determined from historical monitor data.

9. The method of claim 1, wherein the compiled monitor data is displayed as one or more of a graphical index illustrating a variation in intensity of activity.

10. The method of claim 1, wherein the step of compiling further involves the step of identifying a level of granularity for display.

11. The method of claim 1, wherein the location comprises multiple locations.

12. The method of claim 1, wherein the monitor data is communicated via one or more of wireless communication and broadband communication.

13. A computer implemented method for detecting an anomalous event within a security system, the method comprising the steps of:

identifying an activity baseline wherein the activity baseline indicates a normal level of activity;

identifying a threshold level of activity;

gathering monitor data from one or more remote sensors located at a location;

comparing the monitor data with the activity baseline; and determining an anomaly condition based on the step of comparing.

14. The method of claim 13, wherein the step of determining further comprises determining whether the monitor data is above or below the activity baseline by a variance amount, wherein the variance amount is predetermined.

15. The method of claim 13, further comprising the step of sending a notification identifying the anomaly condition to one or more recipients via one or more preferred modes of communication.

16. The method of claim 13, wherein the activity baseline is identified by a subscriber.

17. The method of claim 13, wherein the activity baseline is determined by historical monitor data.

18. The method of claim 17, wherein the historical data comprises one or more of video data and image data.

19. The method of claim 13, wherein the location comprises multiple locations.

20. The method of claim 13, wherein the monitor data is communicated via one or more of wireless communication and broadband communication.

21. A computer implemented method for displaying and controlling physical site security characteristics based on user specified information, the method comprising the steps of:

storing user profile information based on a user subscription wherein profile information comprises notification preferences;

receiving communications that include security device information associated with one or more remote security devices, across multiple locations, associated with a subscribed user;

processing the security device information from the one or more remote security devices, and displaying the security device information through a single online user interface for the multiple locations.

22. The method of claim 21, further comprising the step of:

enabling remote issuance of at least one command that will change at least one physical site security characteristic for one or multiple locations.

23. The method of claim 21, further comprising the steps of:

assigning a first level physical site security access to one or more first level users for a group of the one or more remote security devices; and assigning a second level physical site security access to one or more second level users for the group of the one or more remote security devices, wherein the second level security access is determined by one of the one or more first level users.

24. The method of claim 21, further comprising the step of:

assigning n level physical site security access to one or more n level users, where n represents a number of levels in a physical site security hierarchy, where the n level physical site security access is determined by one or more of the n−1 or higher level users.

25. The method of claim 21, wherein a master code controls the first level security access of the one or more first level users.

26. The method of claim 21, wherein each of the one or more first level users controls a respective one or more second level users.

27. The method of claim 21, wherein the steps of assigning occur over the single online user interface.

28. The method of claim 21, wherein physical site security access is assigned via the single online user interface and is automatically programmed into the one or more security devices, including specific user codes, via a wireless communication from a central network operations center wherein the one or more security devices confirms via wireless communication to the central network operations center that the one or more security devices has received the security access via wireless communication.

29. A computer implemented method for automatically arming a security system, the method comprising the steps of:

identifying an arming trigger for the security system wherein the security system comprises one or more remote sensors;

gathering monitor data from the one or more remote sensors located at a location;

determining whether the arming trigger has occurred based on the monitor data from the one or more remote sensors; and automatically arming the security system, in response to an occurrence of the arming trigger.

30. The method of claim 29, further comprising the steps of:

generating a notification message in response to an occurrence of the arming trigger; and sending the notification message via a preferred method of notification, prior to the step of automatically arming the security system.

31. The method of claim 29, further comprising the step of:

enabling a subscriber to remotely arm the security system after receiving a trigger alert suggesting that the security system should be in an armed state.

32. The method of claim 29, wherein the arming trigger comprises one or more of a trigger time period, a trigger event and an absence of activity.

33. The method of claim 29, further comprising the step of:

identifying a level of security for the security system when the security system is automatically armed.

34. The method of claim 29, wherein the location comprises multiple locations.

35. The method of claim 29, wherein the monitor data is communicated via one or more of wireless communication and broadband communication.

36. A computer implemented method for automatic notification of security information to subscribed users based on user specified information wherein the security information is communicated from security devices associated with the subscription, the method comprising the steps of:

storing user profile information based on a user subscription wherein profile information comprises notification preferences;

receiving communications that include security device information associated with one or more remote security devices associated with a subscribed user when a security system associated with the one or more remote security devices is in an unarmed state; and processing the security device information from the one or more remote security devices, wherein the communications are received by one or more of wireless communication and broadband communication.

37. The method of claim 36, wherein the wireless communication comprises one or more of GSM and wireless broadband.

38. The method of claim 36, further comprising the step of:

remotely programming the one or more remote security devices.

39. The method of claim 36, further comprising the step of:

remotely controlling the one or more remote security devices.

40. A computer implemented method for automatic notification of security information to subscribed users based on user specified information wherein the security information is communicated from security devices associated with the subscription, the method comprising the steps of:

storing user profile information based on a user subscription wherein profile information comprises notification preferences;

receiving communications that include security device information associated with one or more remote security devices associated with a subscribed user;

processing the security device information from the one or more remote security devices;

displaying the processed information wherein the processed information comprises a combination of normal activity and alarm events; and automatically forwarding the processed information to the subscribed user associated with the remote security devices.

41. The method of claim 40, wherein the processed information is forwarded to the subscribed user at periodic intervals.

42. The method of claim 40, wherein the processed information is aggregated into a report to provide management data or summary security information about a remote site associated with a remote security device.

43. The method of claim 40, wherein the processed information is forwarded to the subscribed user based on one or more defined triggering events.

44. The method of claim 40, wherein the processed information is forwarded to the subscribed user at the subscribed user's request.

45. The method of claim 40, wherein the communications of sensor data are received by one or more of wireless communication and broadband communication.

46. A computer implemented method for automatic notification of security information to subscribed users based on user specified information wherein the security information is communicated from security devices associated with the subscription, the method comprising the steps of:

storing user profile information based on a user subscription wherein profile information comprises notification preferences;

receiving communications that include security device information associated with one or more remote security devices associated with a subscribed user;

processing the security device information from the one or more remote security devices; and automatically notifying the subscribed user associated with the remote security devices when an absence of activity is detected by the one or more remote security devices.

47. The method of claim 46, wherein the communications are received by one or more of wireless communication and broadband communication.

48. The method of claim 46, further comprising the step of:

enabling the subscribed user to identify one or more remote security devices to be monitored for no activity.

49. The method of claim 46, wherein the subscribed user defines a no-activity trigger for the absence of activity.

50. The method of claim 46, wherein the step of processing the security device information occurs at a central network operations center.

51. The method of claim 46, wherein the one or more remote security devices are located across multiple locations.

52. A computer implemented method for implementing a hosted security operating system, the method comprising the steps of:

identifying a plurality of monitor devices located at a location;

receiving monitor data from each of the plurality of monitor devices, at a central server location;

processing the received monitor data, at the central server; and storing the monitor data in one or more databases associated with the central server.

53. The method of claim 52, wherein the monitor data is received directly from each of the plurality of monitor devices.

54. The method of claim 52, wherein each of the plurality of monitor devices communicate monitor data to a virtual panel located at the location, wherein the virtual panel forwards the monitor data to the central server.

55. The method of claim 54, wherein a network data hub collects local monitor data and identifies urgent data and sends the urgent data to the central server while non-urgent data is buffered and transmitted to the central server in batch.

56. The method of claim 52, further comprising the step of:

updating at least one of the plurality of monitor devices remotely from the central server.

57. The method of claim 52, further comprising the step of:

remotely controlling at least one of the plurality of monitor devices from the central server.

58. The method of claim 52, wherein the monitor data comprises video data, wherein the video data is correlated with monitor data from the monitor devices in the one or more databases.

59. The method of claim 52, wherein the correlated data is analyzed for detecting an anomalous event.

60. The method of claim 52, further comprising the step of:

transmitting to an intended recipient a video image in an alert message when an alarm worthy event is detected by the one or more monitor devices.

61. The method of claim 52, wherein the location comprises multiple locations.

62. The method of claim 52, wherein the monitor data is communicated via one or more of wireless communication and broadband communication.

63. A computer implemented method for automatic notification of security information to subscribed users based on user specified information wherein the security information is communicated from security devices associated with the subscription, the method comprising the steps of:

storing user profile information based on a user subscription wherein profile information comprises notification preferences;

receiving communications that include security device information associated with one or more remote security devices associated with a subscribed user;

processing the security device information from the one or more remote security devices; and automatically notifying the subscribed user associated with the remote security devices when an alarm event satisfying the user notification preferences is received from the one or more remote security devices;

wherein the user notification preferences comprise notifying a specific recipient based on activity associated with a specific remote security device.

64. The method of claim 63, wherein additional recipients are alerted by a preferred mode of communication, wherein each recipient is alerted based on activity associated with each corresponding security device.

65. The method of claim 63, wherein the communications are received by one or more of wireless communication.

66. A computer implemented method for automatic notification of security information to subscribed users based on user specified information wherein the security information is communicated from security devices associated with the subscription, the method comprising the steps of:

storing user profile information based on a user subscription wherein profile information comprises notification preferences;

receiving communications that include security device information associated with one or more remote security devices associated with a subscribed user;

processing the security device information from the one or more remote security devices; and automatically notifying the subscribed user associated with the remote security devices when a sensor event satisfying the user notification preferences is received from the one or more remote security devices, based on a specified schedule.

67. The method of claim 66, wherein the specified schedule determines whether or not the sensor event is relevant and where the specified schedule dictates a preferred mode of communication to one or more recipients based on a time period.

68. The method of claim 67, wherein the time period refers to a day of the week.

69. The method of claim 67, wherein the communications are received by one or more of wireless communication and broadband communication.

70. A computer implemented method for automatic notification of security information to subscribed users based on user specified information wherein the security information is communicated from security devices associated with the subscription, the method comprising the steps of:

storing user profile information based on a user subscription wherein profile information comprises notification preferences;

receiving communications that include security device information associated with one or more remote security devices associated with a subscribed user;

processing the security device information from the one or more remote security devices; and automatically notifying the subscribed user associated with the remote security devices when a sensor event satisfying the user notification preferences is received from the one or more remote security devices;

wherein the subscribed user identifies a subset of the one or more remote security devices that will cause an automatic notification.

71. The method of claim 70, wherein the subscribed user identifies the subset through an online interface and determines the state of each sensor as it relates to the state of the other sensors in the subset in order to generate a trigger.

72. The method of claim 70, wherein the communications are received by one or more of wireless communication and wired or wireless broadband communication.

* * * * *